US011530579B2

(12) United States Patent
Sahdev et al.

(10) Patent No.: US 11,530,579 B2
(45) Date of Patent: Dec. 20, 2022

(54) METHOD AND APPARATUS FOR DISTRIBUTED FLOW/SEISMIC PROFILING AND EXTERNAL SUPPORT DEVICE

(71) Applicant: Halliburton Energy Services, Inc., Houston, TX (US)

(72) Inventors: Neha Sahdev, Aurora, CO (US); Eric Bivens, Littleton, CO (US); Philippe Quero, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/955,697

(22) PCT Filed: Dec. 28, 2018

(86) PCT No.: PCT/US2018/067826
§ 371 (c)(1),
(2) Date: Jun. 18, 2020

(87) PCT Pub. No.: WO2019/143456
PCT Pub. Date: Jul. 25, 2019

(65) Prior Publication Data

US 2021/0010337 A1 Jan. 14, 2021

Related U.S. Application Data

(60) Provisional application No. 62/619,063, filed on Jan. 18, 2018.

(51) Int. Cl.
*E21B 19/22* (2006.01)
*E21B 47/01* (2012.01)
(Continued)

(52) U.S. Cl.
CPC ..... *E21B 19/22* (2013.01); *E21B 47/01* (2013.01); *E21B 17/20* (2013.01); *E21B 47/06* (2013.01); *E21B 47/107* (2020.05)

(58) Field of Classification Search
CPC ..... E21B 17/20; E21B 19/22; E21B 47/01; E21B 17/10; E21B 47/06; E21B 47/10; E21B 47/107
See application file for complete search history.

(56) References Cited

U.S. PATENT DOCUMENTS 6,026,913 A * 2/2000 Mandal ..... E21B 47/0224 175/45
6,032,748 A * 3/2000 DeBray ..... E21B 17/105 166/241.4

(Continued)

FOREIGN PATENT DOCUMENTS

WO 2016195645 12/2016

OTHER PUBLICATIONS

ISRWO International Search Report and Written Opinion for PCT/US2018/067826 dated Apr. 24, 2019.

*Primary Examiner* — Caroline N Butcher
(74) *Attorney, Agent, or Firm* — Thomas Rooney; C. Tumey Law Group PLLC

(57) ABSTRACT

In the general context of oilfield equipment and, in particular, in the context of downhole tools, the systems and methods relate to characterizing flow in a wellbore using data collection devices, which may be temporarily attached on the outside of a work string to be run into the wellbore. More particularly, the systems and methods may be used for obtaining flow data at a plurality of different locations and correlated with wellbore depth for evaluation of production profiles of wellbores. A system may be provided that comprises a work string, multiple external support devices temporarily secured to an exterior of the work string at a plurality of different locations, and at least one data collection device such as a resistivity gauge, flow meter, and/or Doppler sensor, coupled to the external support devices.
(Continued)

This data, once recovered on surface, could be incorporated into an overall production profile model of the well.

20 Claims, 19 Drawing Sheets

(51) Int. Cl.
*E21B 47/107* (2012.01)
*E21B 17/20* (2006.01)
*E21B 47/06* (2012.01)

(56) References Cited

U.S. PATENT DOCUMENTS

| | | | | |
|---|---|---|---|---|
| 2008/0150305 | A1 | 6/2008 | Hollin | |
| 2011/0005745 | A1* | 1/2011 | Goodwin | E21B 49/10 166/250.01 |
| 2012/0330551 | A1* | 12/2012 | Mitchell | E21B 47/022 702/9 |
| 2013/0105222 | A1 | 5/2013 | Pate | |
| 2014/0367092 | A1* | 12/2014 | Roberson | E21B 47/01 166/250.01 |
| 2015/0144357 | A1* | 5/2015 | Hampson | E21B 19/22 166/381 |
| 2018/0274322 | A1* | 9/2018 | Gamble | E21B 33/063 |

* cited by examiner

METHOD AND APPARATUS FOR DISTRIBUTED FLOW/SEISMIC PROFILING AND EXTERNAL SUPPORT DEVICE

TECHNICAL FIELD

The present disclosure generally relates to oilfield equipment and, in particular, to downhole tools, and related systems and methods for characterizing flow in a wellbore. More particularly, the present disclosure relates to methods and systems for obtaining flow data for evaluation of production profiles of wellbores.

BACKGROUND

Current systems and methods for measuring or detecting fluid flow in wellbores are limited to being deployed only as part of the primary completion. For example, measurement devices are currently installed as permanent completion components and generally employ compartmentalization, e.g., zonal isolation to provide usable measurements. The description provided in the background section should not be assumed to be prior art merely because it is mentioned in or associated with the background section. The background section may include information that describes one or more aspects of the subject technology.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
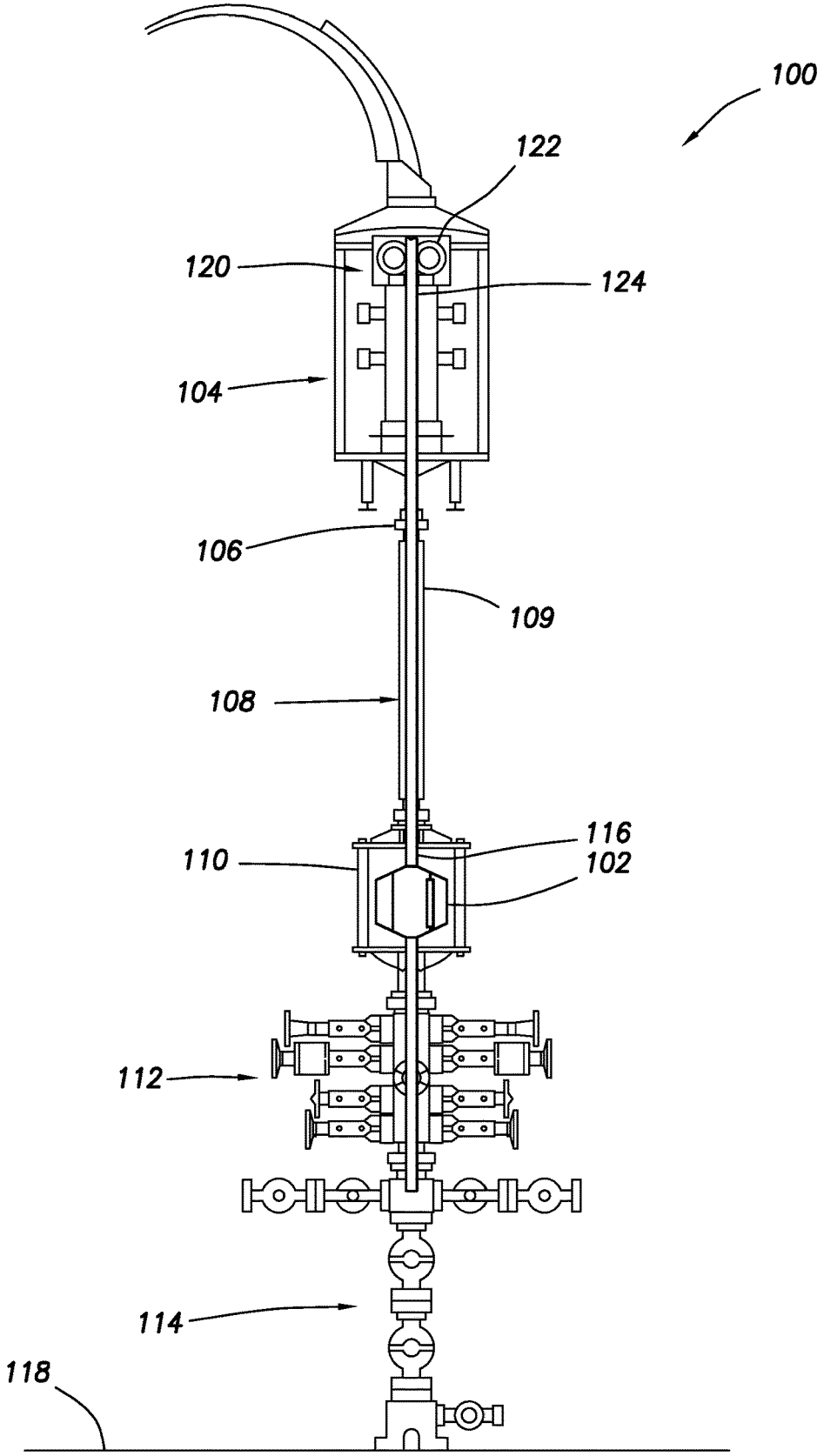
FIG. 1 illustrates an exemplary system for coupling an external support device to a work string, according to some embodiments of the present disclosure.

Various aspects of the present disclosure are directed to systems and methods for characterizing axial flow at a number of desired depths or positions within a wellbore. In particular, the present disclosure is directed to systems and methods of temporarily attaching data collection devices to any point or points along the outside of a work string, e.g., a pipe string or coiled tubing. Embodiments may include an external support apparatus temporarily attached on the outside of the work string, wherein the external support apparatus carries one or more data collection devices. Embodiments of the data collection devices may obtain flow information, for example, to evaluate production profiles. The systems and methods of the present disclosure may further provide the advantage of enabling improved analysis for distributed fiber-optic well profiling. For example, the addition of geophone carriers into the external support apparatus can enable distributed seismic profiling to be performed concurrently with the flow related measurements, as well as provide an additional depth calibration feature to overcome any depth accuracy concerns relative to tubing buckling.

In accordance with some aspects of the present disclosure, the various embodiments of the present disclosure provide a methodology for data collection devices to be deployed into a wellbore on a work string. For example, the external support device carrying the one or more data collection devices may be deployed on a work string that is run into a wellbore. This provides a temporary mechanism to obtain data such as flow information at various locations across the wellbore, for example, to evaluate production profiles. In some embodiments, the methods described herein may be combined with a fiber-optic equipped coiled tubing to enable correlation with distributed acoustic sensing (DAS) and/or distributed temperature sensing (DTS) data for a more complete wellbore profile, but may be deployed as a stand-alone process, independent of fiber-optic data. As will be appreciated, fiber-optic equipped coiled tubing includes coiled tubing that carry fiber-optic cables into the wellbore. In DAS or DTS, the coiled tubing functions as the sensing element for sensing acoustic (DAS) or temperature (DTS) data. In some embodiments, data acquired from the data collection devices (e.g., flow data, geophone data, etc.) may be correlated with the acoustic and/or temperature data from DAS and/or DTS. For example, systems may include a processor that can correlate flow data from flow sensors with data acquired from the fiber-optic cable.

According to various embodiments of the present disclosure, various data collection devices may be integrated into an external support apparatus, which is then coupled to an exterior of a work string to be deployed into a wellbore. The work string may include any suitable conduit used to convey a treatment or well service into a wellbore, including, but not limited to, coiled tubing and jointed pipe. Suitable data collection devices may include any numbers of devices for data collection, including, but not limited to, resistivity gauges, temperature gauge, pressure gauge, flow meters or other suitable sensor (e.g., Doppler sensors for low rate flow detection, gamma ray sensor for measuring gamma radiation, inclination sensor for measuring inclination, magnetometers, accelerometers), and combinations thereof. In some embodiments, the data collection devices may be configured to record data in a memory mode, or to transmit real time data to the surface by means of a wired or wireless telemetry. Additional examples of data collection devices may include geophones, which may be used alone or in combination with the afore-mentioned data collection devices. Addition of geophones to the external support devices may enable, for example, distributed seismic profiling to be performed concurrently with other service applications, as well as provide an additional depth calibration feature to overcome any depth accuracy concerns relative to tubing buckling. In contrast, current geophone technology does not allow for flow through the deployment string, so the geophone technology cannot be combined with additional downhole services on the same run. In addition, current fiber-optic vertical seismic profile time applications for seismic data do not provide wellbore coupling, which can diminish data sensitivity. The external support device may be designed to house or otherwise be coupled to one or more data collection devices. The data collection devices may be spaced and oriented relative to each other so as to maximize coverage for accurate measurement. In some embodiments, a sample chamber may also be integrated into the external support apparatus. Additional components that may be used in conjunction with the data collection devices for collecting and storing data may also be integrated into the external support apparatus, including, but not limited to, battery packs, memory modules, sensor control modules, and combinations thereof. Control module may include a suitable processor, including, but not limited to, a microprocessor, microcontroller, embedded microcontroller, programmable digital signal processor, or other programmable device. Memory module may include any suitable form of data storage, including, but not limited to, electronic, magnetic, or optical memory, whether volatile or non-volatile.

In operation, embodiments may include deploying the external support device into a wellbore bore on a work string to a position downhole that may be correlated to a target location (e.g., depth, position in a horizontal wellbore, etc.). The target location may be associated, for example, with a producing zone. At the target location, the work string may be held static while data is collected. By way of example, data measurements (e.g., annular flow data) may be obtained by the data collection devices and recorded on a memory module integrated into the external support device. The flow path may include, for example, the annulus between the work string and a large conduit (e.g., liner, casing string, etc.) or wellbore walls (e.g., in an open hole completion). The data measurements may include various wellbore data, including, but not limited to, fluid flow, gas/oil/water content, pressure, temperature, gamma radiation, inclination, toolface, or any other applicable data. In some embodiments, annular flow data may be monitored and recorded to determine flow contribution from zones relative to the position of the deployed data collection devices in the wellbore. The various data, once recovered on surface, may be incorporated into an overall production profile model of the well. In some embodiments, external fluid may be collected and stored in a sample chamber formed in stabilizer (e.g., fin) of the external support device for testing at the surface after recovery. External support devices may be repositioned to monitor various points or flow conditions in the well, or multiple external support devices may be connected to the work string to configure the data acquisition points as desired. As discussed above, in some embodiments, the external support device may be coupled to a work string incorporating a fiber-optic cable which can yield additional profile data and correlation information. However, the external support devices described herein are not limited to the aforementioned configuration, but may be instead be disposed on standard work strings as well.

Any suitable technique may be used for attachment of the external support device onto the work string. In some embodiments, the external support device may in the form of an external clip on assembly that can be secured onto the work string, for example, while being run downhole. For example, the external support device may include a hinged clamp and a locking pin for securing the external device to the work string. By way of further example, the external device may be divided into two parts that may disposed around the work string and secured to one another by any suitable mechanism, such as bolts or other fasteners. In yet further embodiments, the external support device may be formed as an adhesive or wrap type assembly that may be applied to the work string while being run downhole, or prior to commencing wellbore operations. In yet further embodiments, the external support device may be affixed to the work string by other means, such as, but not limited to, bolts, screws, magnets, tack welding, clamps or other bracketing mechanisms. In some embodiments, additional mechanisms may be used to prevent slippage when coupled to the work string, including, but not limited to, set screws, rubber or elastomeric gaskets or seals, slip teeth, or any other acceptable securing method to prevent slippage.

In accordance with some embodiments as described herein, the data collection devices, being of such reduced size as compare to conventional data gathering/measurement components, may be incorporated onto the external support devices coupled to the work string in the various ways described above, before running the work string downhole. In some embodiments, the external support devices may also be applied to the work string at the reel at any point during deployment into the well, or prior to an operation, thereby eliminating the need to utilize a work window or access point in the rigging stack. In some embodiments, the external support device may be attached to the work string while running in hole, for example, through a work window in the rigging stack. That is, the external support devices may be installed on the work string (e.g., coiled tubing, jointed pipe, etc.) through an opening in the rigging stack where the connection is temporarily broken to enable an access window (referred to herein as the "work window"). On jointed pipe, for example, the external support device may be coupled at any point in the operation prior to the target pipe section being run below surface.

In some embodiments, the external support devices as described herein may be sized specific to the diameter of the work string they are to be coupled to. For example, the external support device may have a central opening with a diameter of about 0.25 inches (in) (0.64 centimeters (cm)) to about 3.5 in (8.9 cm). Alternatively, the external support device may have a central opening with a diameter of about 0.25 in (0.64 cm) to about 1 in (2.54 cm), or about 1 in (2.54 cm) to about 3.5 in (8.9 cm), or about 1.25 in (3.2 cm) to about 2.875 in (7.3 cm). However, in other embodiments, the external support devices may be slightly undersized relative to the work string, to allow tightening around a range of tubing sizes or to facilitate an alternate grip method of the external support devices on the work string.

In some embodiments, the external support devices may be formed externally/outwardly facing relative to the work string, for the data collection devices to be able to evaluate conditions on the outside of the work string. Alternatively, the external support devices may be formed internally facing, relative to the work string, for the data collection devices to evaluate conditions inside the work string. That is, the data collection devices, e.g., gauges, sensors, etc., may be inward facing for purposes such as monitoring fluid density of solid content of fluid passing inside the work string. This may be applied to work strings for such applications as tracking viscous gel sweeps or fluid slurries containing solids as they are circulated through the work string. Similar components may be applied to flow pack lines to evaluate the solids content of fluid in the flow back line.

Thus, the various aspects of the present disclosure provide several advantages not provided by conventional methods and systems of data gathering. In particular, various embodiments of the present disclosure provide the following advantages, as shall be described in further detail. First, example embodiments provide the ability to connect multiple removable data collection devices on the outside of a work string during an operation, at any location along the work string. Second, example embodiments provide the ability to measure axial flow, distributed across a wellbore. Third, example embodiments provide the ability to combine data collection devices installed at various positions (e.g., depths, lateral positions in a horizontal wellbore, etc.) along a work string with distributed fiber-optic DTS and DAS data. Fourth, example embodiments provide the ability to deploy subsurface geophones while maintaining ability to circulate through the work string.

Thus, the various embodiments of the present disclosure may provide more accurate measurement of flow conditions in the wellbore at several desired positions at various times during the life of the wellbore. Embodiments of the systems and methods of the present disclosure may provide allow the obtainment of data from within the wellbore that depicts a more accurate representation of flow conditions downhole, without the disadvantage of incidentally inducing flow as commonly occurring with conventional methods of obtaining flow data. In some embodiments, as shall be described in further detail below, the coiled tubing may be fiber-optics enabled coiled tubing. Utilizing fiber-optics enabled coiled tubing yields the advantage of providing DAS data or DTS data along the entire wellbore. In contrast to conventional methods of utilizing fiber-optics, where the fiber-optics are permanently deployed as part of the wellbore for life of the wellbore, the present disclosure provides systems and methods for deploying the fiber-optics as part of the coiled tubing, thereby eliminating the need to stop production operations, or interrupt flow of production fluids during well operation in order to obtain flow data.

The methods and systems of the present disclosure may thus expand the capabilities that currently exist for taking distributed flow measurements across the length of the wellbore by providing production logging tools capable of performing measurements at a number of desired positions along the wellbore, as opposed to conventional tools which have the capabilities of measuring mostly from the bottom of the work string and wellbore. Thus, with the systems and method of the present disclosure, it may be possible to obtain acoustic and the thermal profile across the entire wellbore. Some embodiments of the systems and methods of the present disclosure provide a way to integrate various data measurement and collection components into existing work strings, e.g., coiled tubing, in a distributed fashion. As such, some embodiments of the present disclosure describes an external support apparatus, which may be easily attached to an exterior of the work string at a plurality of positions, so as to provide the capability to measure flow data at as many points across the wellbore as desired. The systems and methods of the present disclosure, in some embodiments, may thus yield the advantage of allowing well operators to be able to differentiate the characteristics of the flow at certain points along the wellbore, e.g., distinguishing oil content versus water content versus gas content. Example embodiments that utilize coiled tubing may further provide the capability of running the work string into a live well, where production fluids are currently flowing, without interrupting or otherwise influencing the flow of production fluids.

In contrast to conventional data collection devices which are typically deployed as part of the primary completion, example embodiments of the data collections devices on the external support devices may allow for flow evaluation to be applied to any wellbore, regardless of original completion method. As described herein, embodiments of the external support devices deployed on coiled tubing can be run at any time during the life of the well, so as to obtain more comprehensive flow information along the wellbore. In accordance with some embodiments described herein where the coiled tubing is fiber-optics enabled coiled tubing, obtained data may provide an increased confidence factor to flow allocation. In addition, the obtained data may enable proper evaluation of additional flow regimes and flow paths, including axial flow, as well as an accurate means of differentiating between oil and water content of the annular fluid.

FIG. 1 illustrates an embodiment of a system 100 for coupling an external support device 102 to a work string 116, according to some embodiments of the present disclosure. In the illustrated embodiments, the work string 116 is coiled tubing. In some embodiments, the work string 116 in the form of coiled tubing may be a continuous length of steel or composite tubing that is flexible enough to be wound on a large reel (not shown) for transportation. The system 100 may further include an injector 104, a stripper 106, a pressure containment device, e.g., a lubricator 108, a work window 110, a blowout preventer (BOP) 112, and a wellhead 114. In operation, the work string 116 may be injected into the existing production string (not shown), unwound from the reel (not shown) and inserted into the well by of the wellhead 114. In some embodiments, coiled tubing may be chosen over conventional tubing because conventional tubing has to be screwed together. Additionally, coiled tubing does not require a workover rig. Because coiled tubing is inserted into the well while production is ongoing, it is also a cost-effective choice and can be used on high-pressure wells. However, the present techniques are not limited to use of coiled tubing and, it should be understood, that work string 116 may include any suitable conduit used to convey a treatment or well service into a wellbore, including jointed pipe.

In the depicted embodiments, the injector 104 includes a drive chain assembly 120, including a motor 122 with a gripper chain 124 to run the continuous work string 116 into and out of the wellbore. That is, the injector 104 is the equipment component used to grip the work string 116, in some embodiments, and provide the forces needed for deployment and retrieval of the work string 116 into and out of the wellbore. As illustrated, the stripper 106 may be mounted on the injector 104, for example, to provide a hydraulic seal around the work string 116. To this effect, the stripper 106 may include an elastomeric seal (not shown) that contains the well pressure when the work string 116 is run through the live well past the elastomeric seal.

In the depicted embodiments, the lubricator 108 is a tube 109 that provides a pressure seal so as to maintain the work string 116 just above the wellhead 114. The lubricator 108 may be used to safely contain the work string 116 under pressure while entering the well or exiting the well. To this effect, lubricator 108 sections may be configured to provide overall length, sufficient enough to accommodate a required work string 116 configuration. The work string 116 may then be placed in the lubricator 108, and the lubricator 108 may then be pressurized to wellbore pressure. A hydraulic pack-off (not shown) may be positioned above the lubricator 108 to provide a pressure seal on the work string 116and the work string 116 may be pushed into the wellbore.

In accordance with various embodiments of the present disclosure, as illustrated in FIG. 1, the work window 110 may installed above the BOP 112 to provide safe work string 116 tubing hang-off and other work string 116 operational procedures. After the work string 116 is landed at a desired wellbore depth, the annulus pressure may be controlled with the BOP 112. Applied hydraulic pressure to an internal hydraulic piston opens the work window 110 to expose the work string 116. Thus, with the window open, equipment, e.g., the external support devices 102 (described in further detail below) may be safely installed onto the work string 116. Reversal of the hydraulic pressure should return the work window 110 to its closed position.

In accordance with some embodiments, the BOP may include blades designed to cut the work string 116 when the BOP is closed, and then fully close to provide isolation or sealing of the wellbore. To this effect, the BOP 112 may serve to prevent the release of wellbore fluids which may cause significant damage. In accordance with some embodiments, the BOP 112 may include several rams, e.g., pipe rams, slip rams, shear rams, and blind rams. When the pipe rams are activated, they seal around the work string 116 to prevent movement of any fluids through the work string 116 annulus. The slip rams may prevent the work string 116 from moving upwards or downwards, i.e., in the longitudinal direction. Shear rams may cut through the work string 116 in order to seal the wellbore. As illustrated, the lower two rams may hold the sealer on the work string 116 to provide a safe way to open the work window 110 in preparation for attaching one or more external support devices 102.

In accordance with some embodiments, the wellhead 114 is the primary seal for opening and closing the well. The work string 116 with the one or more external support devices 102 may thus be run into the wellbore through the wellhead 114.

Figure 2A:
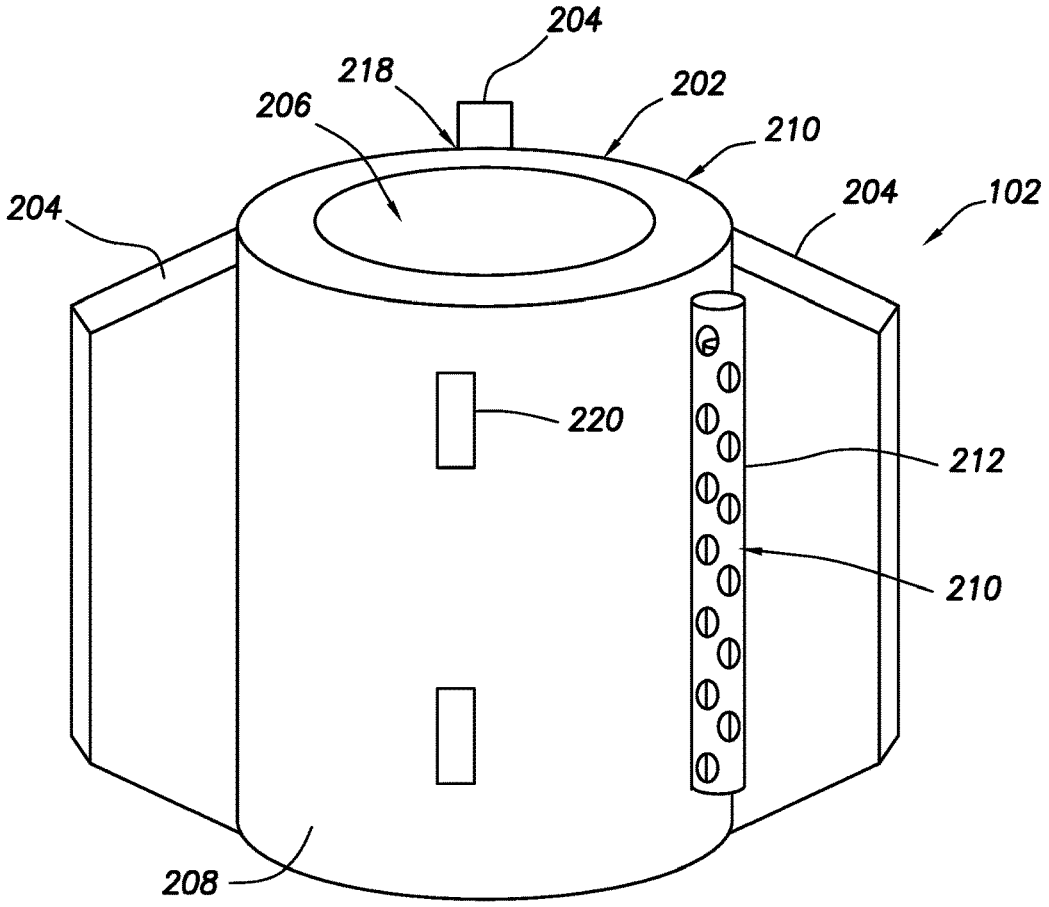
FIG. 2A illustrates a perspective view of an exemplary external support device for attaching to a work string, according to some embodiments of the present disclosure.
Figure 2B:
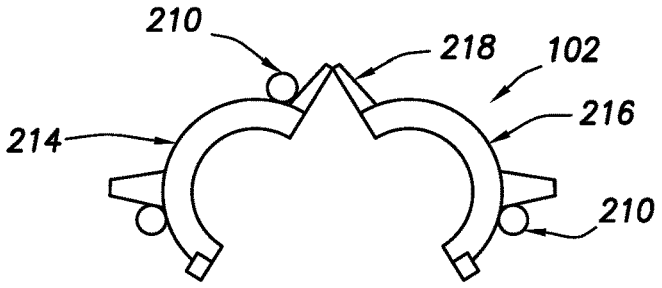
FIGS. 2B and 2C are top views of the external support device of FIG. 2A illustrating how the external support device is coupled to the work string, according to some embodiments of the present disclosure.
Figure 2C:
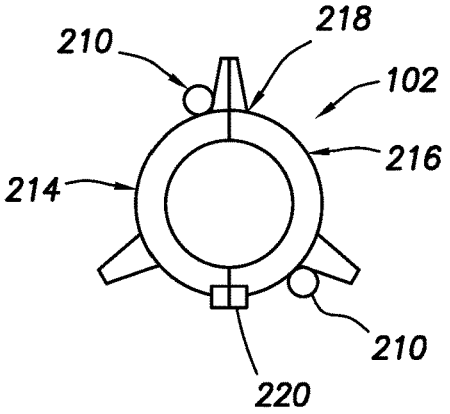

FIG. 2A illustrates a perspective view of an exemplary external support device 102 for attaching to a work string 116 (e.g., shown on FIG. 1), according to some embodiments of the present disclosure. FIGS. 2B and 2C are top views of the external support device 102 of FIG. 2A illustrating how the external support device is coupled to the work string, according to some embodiments of the present disclosure.

In accordance with some embodiments, the external support device 102 may be similar to, or the same as, and may serve the same purpose as the external support device 102 illustrated in FIG. 1. As illustrated, the external support device 102 may include a body 202 and fins 204. As illustrated, body 202 may be generally cylindrically in shape attachment onto the work string 116 (e.g., shown on FIG. 1). However, many other shapes of body 202 may be anticipated corresponding to the shape of the work string 116 to which the external support device 102 will be attached. Body 202 may define a central opening 206 for receiving the work string 116 that extends through external support device 102. As illustrated, the fins 204 may extend radially from an outer surface 208 of the body 202. In the illustrated, external support device 102 includes three of the fins 204, but embodiments may include more or less than three of the fins 204 as desired for a particular application. However, it should be understood that while fins 204 are illustrated, embodiments may include other suitable stabilizers that extend outwardly from the outer surface 208 of the body 202.

As best seen on FIG. 2A, external support device 102 may carry a data collection device 210 for obtaining downhole measurements, as described above. In some embodiments, data collection device 210 may include a device for measuring various flow conditions, at a desired location, when placed in the wellbore. Data collection device 210 may be coupled to the external support device 102 in any suitable matter. For example, the data collection device may be coupled to, or integrated into body 202 and/or fins 204 of the external support device 102. In the illustrated embodiment, the external support device 102 may include a device housing 212 for the data collection device 210. As illustrated, the device housing 212 may be attached to the outer surface 208 of the body 202. In some embodiments, the data collection device 210 may further include a sample chamber (not shown). The sample chamber, for example, may be integrated into one of the fins 204 of the external support device 102. When downhole, external fluids may be collected in the sample chamber and then returned to the surface for testing.

Referring again to FIGS. 2A-2C, the external support device 102 may have a hinge-and-locking-pin-type configuration. In these embodiments, the external support device 102 may be formed of two portions, hingedly connected to each other. As illustrated, the external support device 102 may include a first portion 214 and a second portion 216 joined at hinged connection 218. In the illustrated embodiment, the hinged connection 218 is formed at one of the fins 204. FIG. 2B illustrates the external support device 102 in an open configuration. To secure the external support device 102 on the work string 116, in some embodiments, the first portion 214 and the second portion 216 may be rotated towards each other from the open configuration, illustrated in FIG. 2B, to a closed configuration, illustrated in FIG. 2C, with the external support device 102 being concentrically disposed about a portion of the work string 116. The external support device 102 may thus be secured into place at a desired position on the work string 116 using a locking pin 220 (best seen on FIGS. 2B and 2C), or other suitable fastener, to lock the first portion 214 and second portion 216 of the external support device 102 to each other.

Figure 3A:
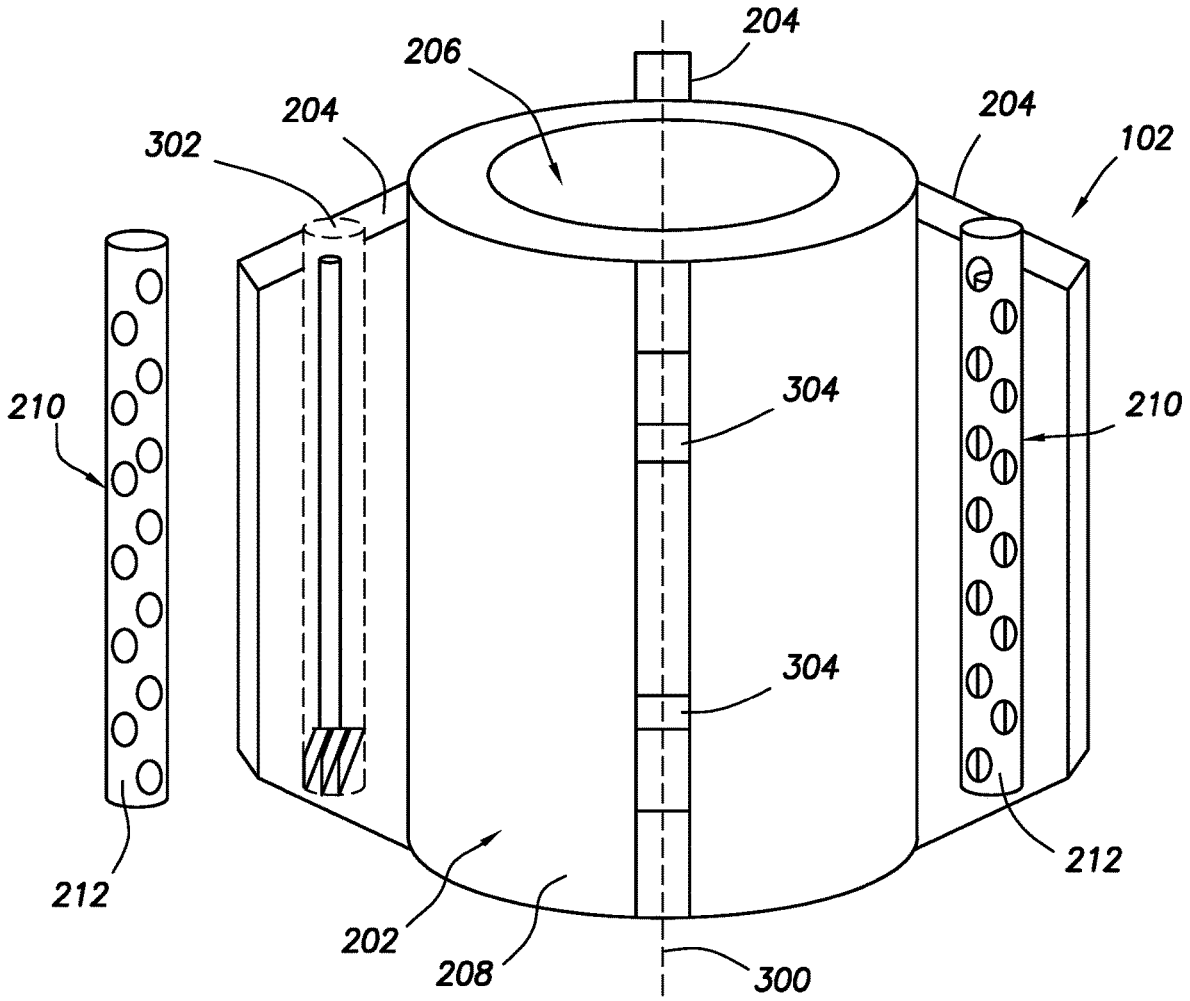
FIG. 3A illustrates a perspective view of an exemplary external support device for attaching to a work string, according to some embodiments of the present disclosure.
Figure 3B:
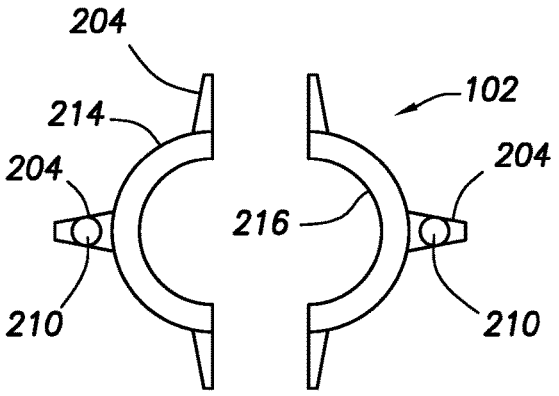
FIGS. 3B and 3C are top views of the external support device of FIG. 3A illustrating how the external support device is coupled to the work string, according to some embodiments of the present disclosure.
Figure 3C:
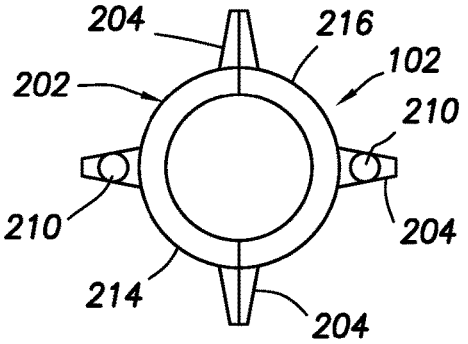

FIG. 3A illustrates a perspective view of an exemplary external support device 102 for attaching to a work string 116 (e.g., shown on FIG. 1), according to some embodiments of the present disclosure. FIGS. 3B and 3C are top views of the external support device 102 of FIG. 3A illustrating how the external support device 102 is coupled to the work string, according to some embodiments of the present disclosure.

In accordance with some embodiments, the external support device 102 may be similar to, or the same as, and may serve the same purpose as the external support device 102 illustrated in FIG. 1. As illustrated, the external support device 102 may include a body 202 and fins 204. As illustrated, body 202 may be generally cylindrically in shape attachment onto the work string 116 (e.g., shown on FIG. 1). However, many other shapes of body 202 may be anticipated corresponding to the shape of the work string 116 to which the external support device 102 will be attached. Body 202 may define a central opening 206 for receiving the work string 116 that extends through external support device 102. As illustrated, the fins 204 may extend radially from an outer surface 208 of the body 202. In the illustrated, external support device 102 includes four of the fins 204, but embodiments may include more or less than four of the fins 204 as desired for a particular application.

As best seen on FIG. 3A, external support device 102 may carry one or more data collection devices 210, similar to that of FIGS. 2A-2C for obtaining downhole measurements, as described above. In the illustrated embodiment, the external support device 102 includes two of the data collection device 210. However, it should be understood that embodiments may include more or less than two of the data collection devices 210. In some embodiments, data collection devices 210 may include a device for measuring various flow conditions, at a desired location, when placed in the wellbore. Data collection devices 210 may be coupled to the external support device 102 in any suitable matter. For example, the data collection devices 210 may be coupled to, or integrated into body 202 and/or fins 204 of the external support device. In the illustrated embodiment, each of the data collection devices 210 may be integrated into separate ones of the fins 204. This configuration may yield the advantage of positioning the data collection devices further radially outward from a central axis 300 of the external support device 102, thereby allowing measurements to be taken in different flow areas as compared to the data collection devices 210 illustrated in FIGS. 2A-2C. In some embodiments, the external support device 102 may include a device housing 212 for the data collection device 210. As illustrated, the device housing 212 with the respective external support device may be integrated into the fins 204. As illustrated, the fins 204 may include a device receptacle 302 for receiving the device housing 212.

Referring again to FIGS. 3A-3C, the external support device 102 may have a split-assembly-type configuration. In these embodiments, the external support device 102 may be formed of two portions which are which are coupled to each other to form the external support device 102. As illustrated, the external support device 102 may include a first portion 214 and a second portion 216 FIG. 3B illustrates the external support device 102 in an open configuration with the first portion 214 and the second portion 216 separated. To secure the external support device 102 on the work string 116, in some embodiments, the first portion 214 and the second portion 216 may be jointed together in a closed configuration, illustrated in FIG. 3C, with the external support device 102 being concentrically disposed about a portion of the work string 116. As best seen in FIG. 3A, bolts 304, or any other appropriate fasteners, may be disposed through an opposing pair of the fins 204 to secure the first portion 214 and the second portion 216 to one another, thus securing the external support device 102 onto a work string 116 (e.g., shown on FIGS. 5A-5D), thereby enabling the data collection devices to be placed along the work string 116 at any desired location.

Figure 4:
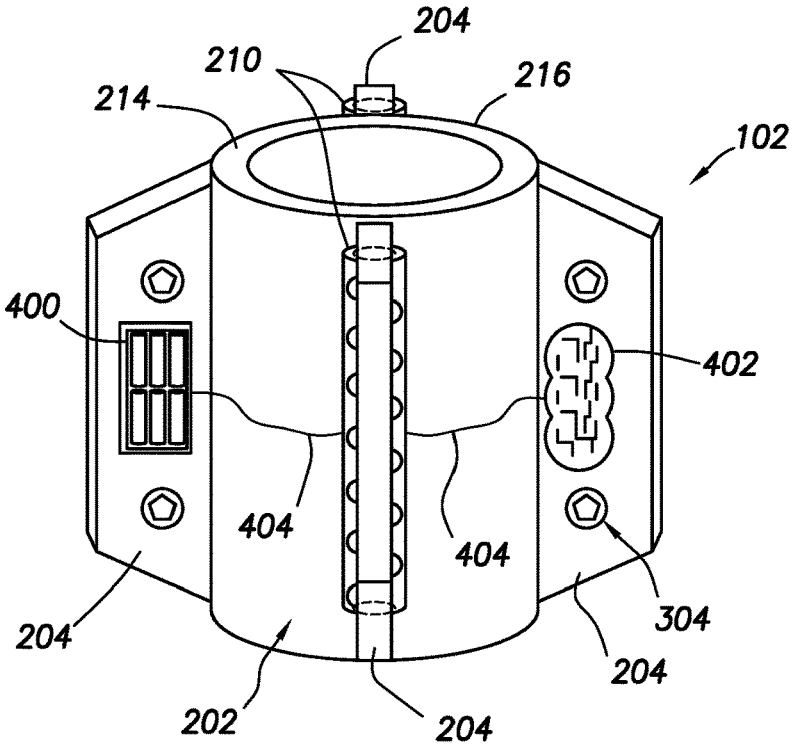
FIG. 4 illustrates a perspective side view of the exemplary external support device of FIG. 3A rotated 90 degrees, according to some embodiments of the present disclosure.

FIG. 4 illustrates a perspective side view of the exemplary external support device 102 of FIG. 3A rotated 90 degrees, according to some embodiments of the present disclosure. As illustrated in FIG. 4, the external support device 102 further includes a battery module 400 and a circuit board 402. While not shown separately, circuit board 402 may include, for example, a memory module and/or a control module. In the illustrated embodiment, the battery module 400 is positioned or integrated at least partially into one of the fins 204 of the external support device 102, and a circuit board 415 is integrated into another of the fins 204. However, it should be understood that the battery module 400 and circuit board 402 may be otherwise positioned as desired for a particular application. For example, while not shown, the battery module 400 and circuit board 402 may be coupled to, or otherwise integrated into, the body 202.

As illustrated, each of the battery module 400 and the circuit board 402 may be connected to the data collection devices 210 so as to provide power and receive information therefrom, respectively. For example, connection lines 404 may be provided connecting the battery module 400 and the circuit board 402 to the data collection devices 210 for sending and receiving power and/or data. In alternate embodiments (not shown), each of the fins 204 may have more than one component selected from the data collection devices 210, the battery module 400, and the circuit board 402 integrated therein. Each of the aforementioned components may of such small size that conceivably all of the components (e.g., data collection devices 210, the battery module 400, and the circuit board 402) may be positioned on one or more of the fins 204. As illustrated, the data collection devices 210, the battery module 400, and the circuit board 402 have been segregated in FIG. 4 for clarity only. In some embodiments, all fins 204 may contain data collection devices 210, the battery module 400, and/or the circuit board 402 as needed.

In the illustrated embodiment of FIG. 4, the external support device 102 is of the split-assembly-type configuration, for example, with bolts 304 securing the first portion 214 and the second portion 216 of the external support device to one another. However, it should be understood that other configurations of the external support device, for example, the hinge-and-locking-pin-type configuration of FIGS. 2A-2C may incorporate the battery module 400 and the circuit board 402, as shown on FIG. 4.

Figure 5A:
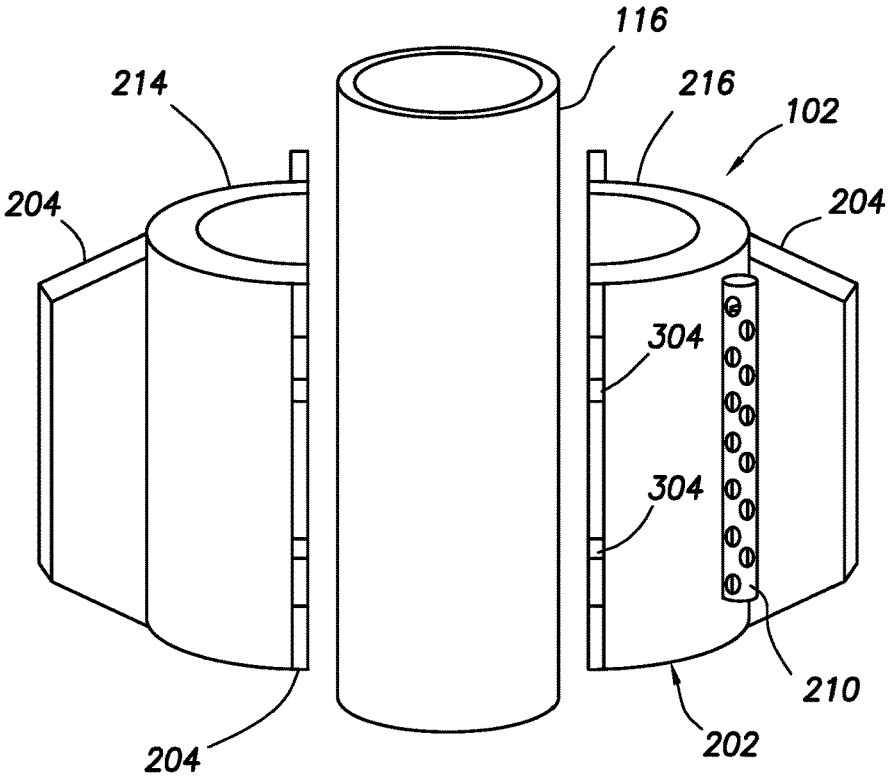
FIGS. 5A and 5B are side perspective views of an external support device illustrating how the external support device is coupled to a work string, according to some embodiments of the present disclosure.
Figure 5B:
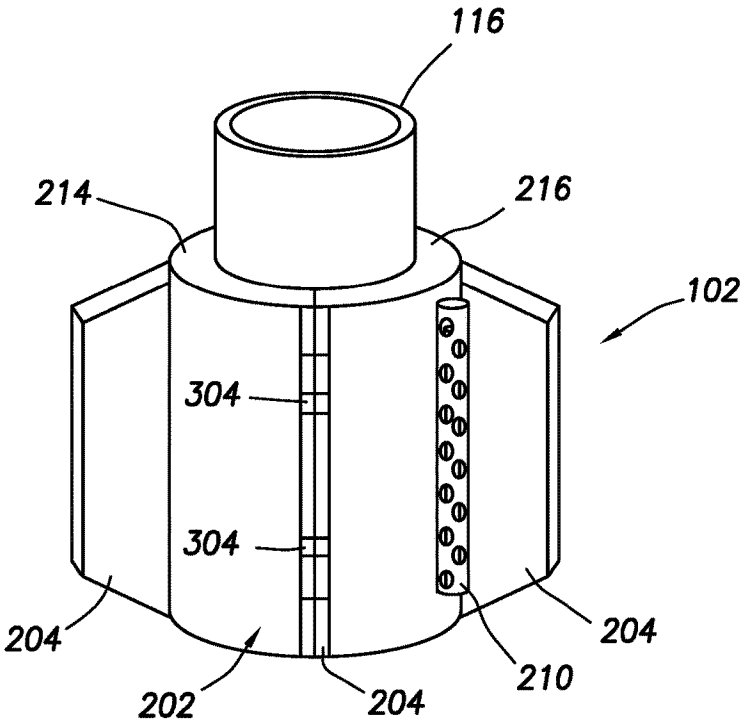
Figure 5D:
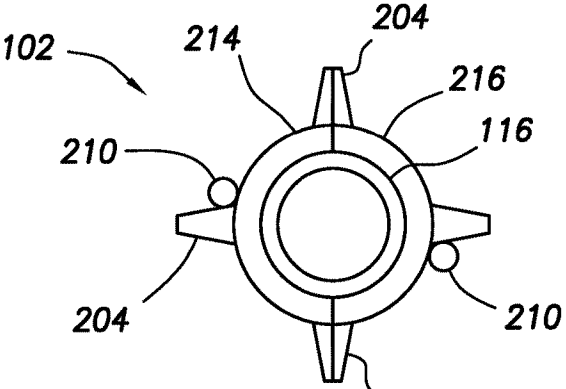
FIGS. 5C and 5D are top views of the external support device of FIGS. 5A and 5B, illustrating how the external support device is coupled to the work string, according to some embodiments of the present disclosure.
Figure 5C:
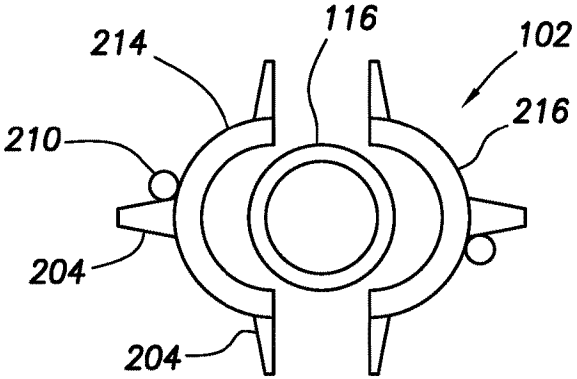

FIGS. 5A and 5B are side perspective views of an external support device 102 of a split-assembly-type configuration, illustrating how the external support device 102 is coupled to the work string 116, according to some embodiments of the present disclosure. FIGS. 5C and 5D are top views of the external support device 102 of FIGS. 5A and 5B, illustrating how the external support device 502 is coupled to the work string 116, according to some embodiments of the present disclosure. Similar to the external support device 102 illustrated on FIGS. 2A-2c, the data collection devices 210 of the external support device 102 shown on FIGS. 5A-5D are positioned or integrated at least partially into the body 202 of the external support device 102. However, the external support device 502 may otherwise be similar to, or the same as, and may serve the same purpose as the external support device 102 illustrated in FIG. 3A. In some embodiments, the body 202 of the external support device 102 may be formed of at least two parts or halves, shown as first portion 214 and second portion 216, which are coupled to each other to form the external support device 102. As depicted, the body 202 of the external support device 502 may be formed as a two-part assembly including the first portion 214 and the second portion 216. The first portion 214 and the second portion 216 may be affixed by bolts 304 integrated into the fins 204, or any other appropriate fasteners, for securing the first portion 214 and the second portion 216 on the work string 116, thereby enabling the data collection devices 210 to be placed along the work string 116 at any desired location.

Figure 6:
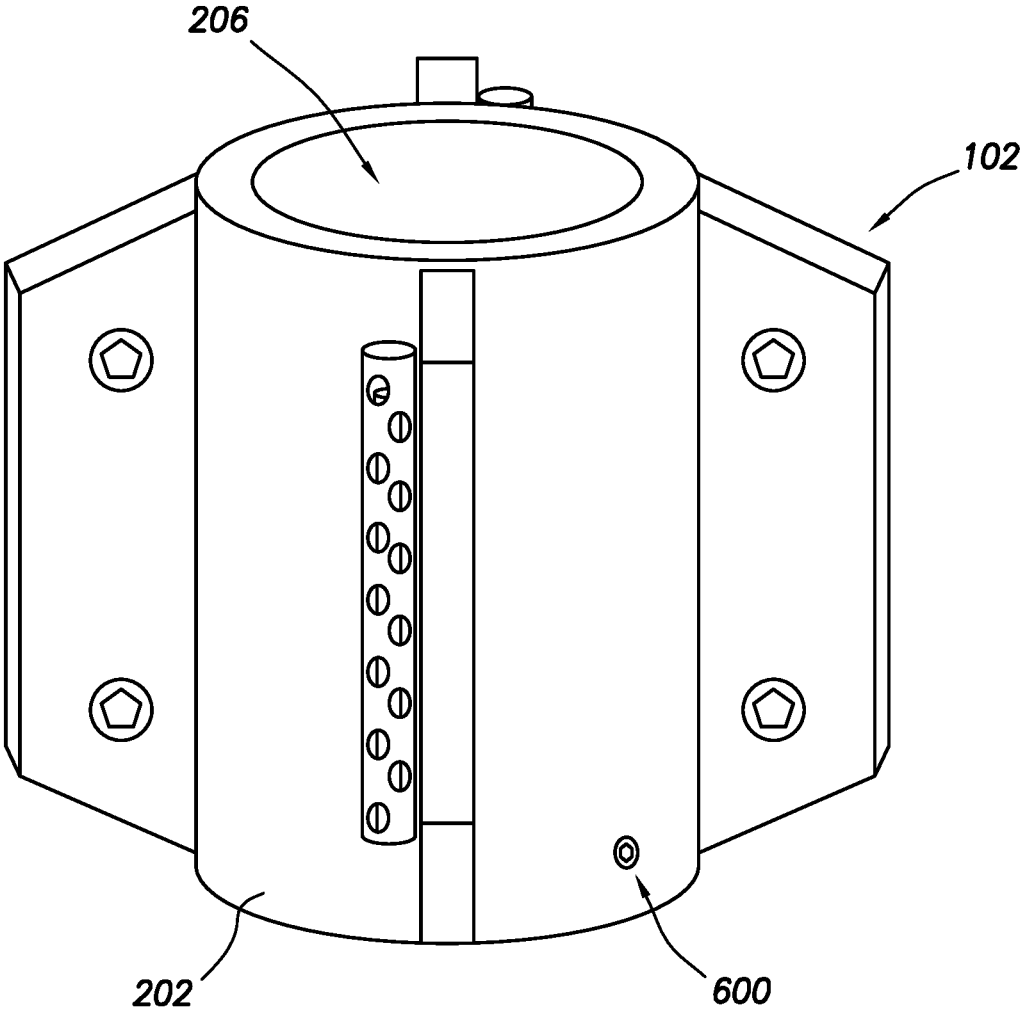
FIG. 6 illustrates a perspective side view of the external support device of FIGS. 4A and 4B rotated 90 degrees, according to some embodiments of the present disclosure.

FIG. 6 illustrates a perspective side view of the external support device 102 of FIG. 5A rotated 90 degrees, according to some embodiments of the present disclosure. As illustrated in FIG. 6, the external support device 102 further includes an optional locking screw 600 to hold the external support device 102 in place on the work string 116 and prevent the external support device 102 from being displaced longitudinally along the work string 116. As illustrated, the locking screw 600 may extend through body 202 to engage the work string 116 (e.g., FIGS. 1 or FIGS. 5A-C) disposed in central opening 206. In other embodiments, the external support device 102 may be held in place, for example, with a gasket seal, a slip face, a back-up clamp, or some other means of preventing the external support device 102 from sliding out of position.

Figure 7A:
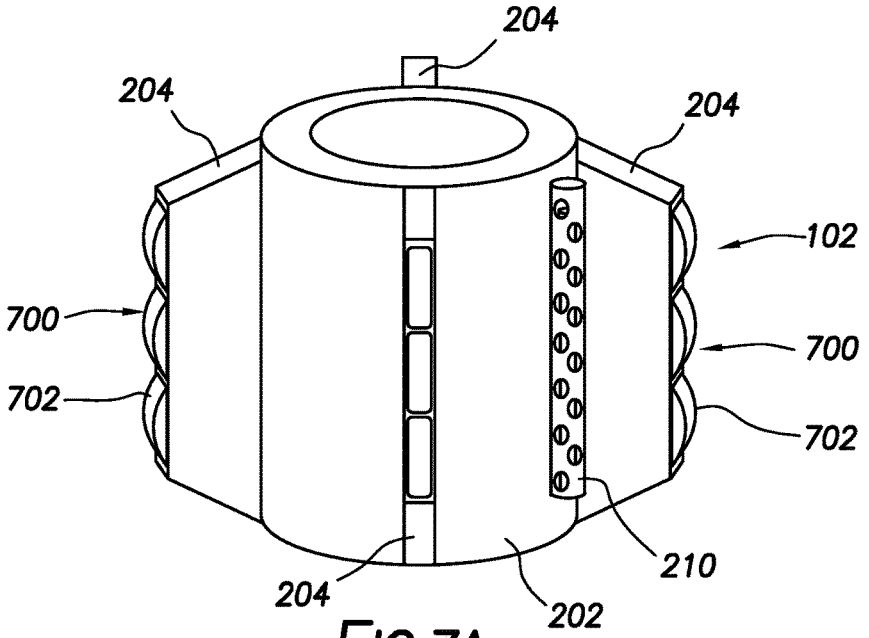
FIG. 7A illustrates a perspective view of an exemplary external support device for attaching to a work string, according to some embodiments of the present disclosure.
Figure 7B:
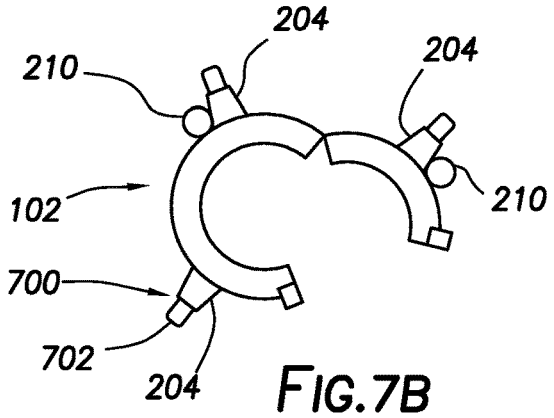
FIGS. 7B and 7C are top views of the external support device of FIG. 7A illustrating how the external support device is coupled to the work string, according to some embodiments of the present disclosure.
Figure 7C:
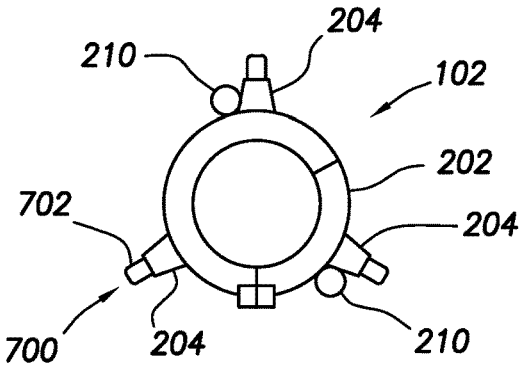
Figure 7D:
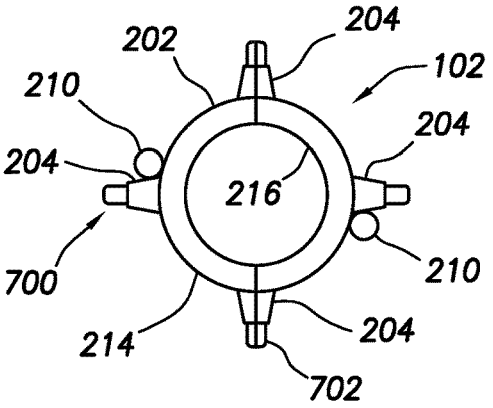
FIGS. 7D and 7E are top views of the external support device of FIG. 7A illustrating how the external support device is coupled to the work string, according to some embodiments of the present disclosure.
Figure 7E:
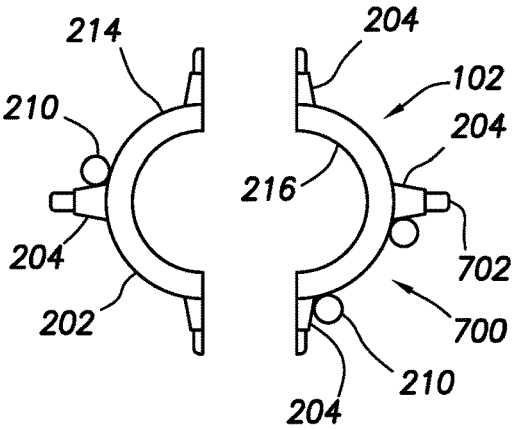

FIG. 7A illustrates a perspective view of an exemplary external support device 102 for attaching to a work string 116 (e.g., FIGS. 1 or FIGS. 5A-C), according to some embodiments of the present disclosure. FIGS. 7B and 7C are top views of the external support device of FIG. 7A illustrating how the external support device 102 is coupled to the work string 116, according to some embodiments of the present disclosure. FIGS. 7D and 7E are top views of the external support device 102 of FIG. 7A illustrating how the external support device 102 is coupled to the work string 116, according to other embodiments of the present disclosure. Similar to the external support device 102 of FIGS. 2A-2C, the data collection device 210 of the external support device 102 may be positioned or integrated at least partially into the body 202 of the external support device 102. However, the data collection device 210 may be otherwise positioned as desired for a particular application, for example, in the fins 204. As illustrated in FIGS. 7A-7E, for example, where each of the fins 204 may extend far enough outwards to potentially contact the wellbore, each of the fins 204 may include a wall contact member 700 integrated into the fins 204 to reduce potential drag friction and improve reach capability in deviated or horizontal wells. In some embodiments, one or more, but not all of the fins 204 may have wall contact members 700 integrated therein. Wall contact member 700 may be any suitable member for reducing potential drag friction, such as wheels 702 or polytetrafluoroethylene pads (not shown).

FIGS. 7B and 7C illustrate the external support device 102 of FIG. 7 having hinge-and-locking-pin-type configuration, according to some embodiments of the present disclosure. For securing onto a work string 116, the external support device 102 may be transitioned from an open configuration, illustrated on FIG. 7B, to a closed configuration, illustrated on FIG. 7C. More details on an example hinge-and-locking-pin-type configuration are described above with respect to FIGS. 2A-2C.

FIGS. 7D and 7E illustrate the external support device 102 of FIG. 7 having split-assembly-type configuration, according to some embodiments of the present disclosure. For securing onto a work string 116, the external support device 102 may be transitioned from an open configuration, illustrated on FIG. 7D, to a closed configuration, illustrated on FIG. 7E. More details on an example split-assembly-type configuration are described above with respect to FIGS. 3A-3C.

Figure 8A:
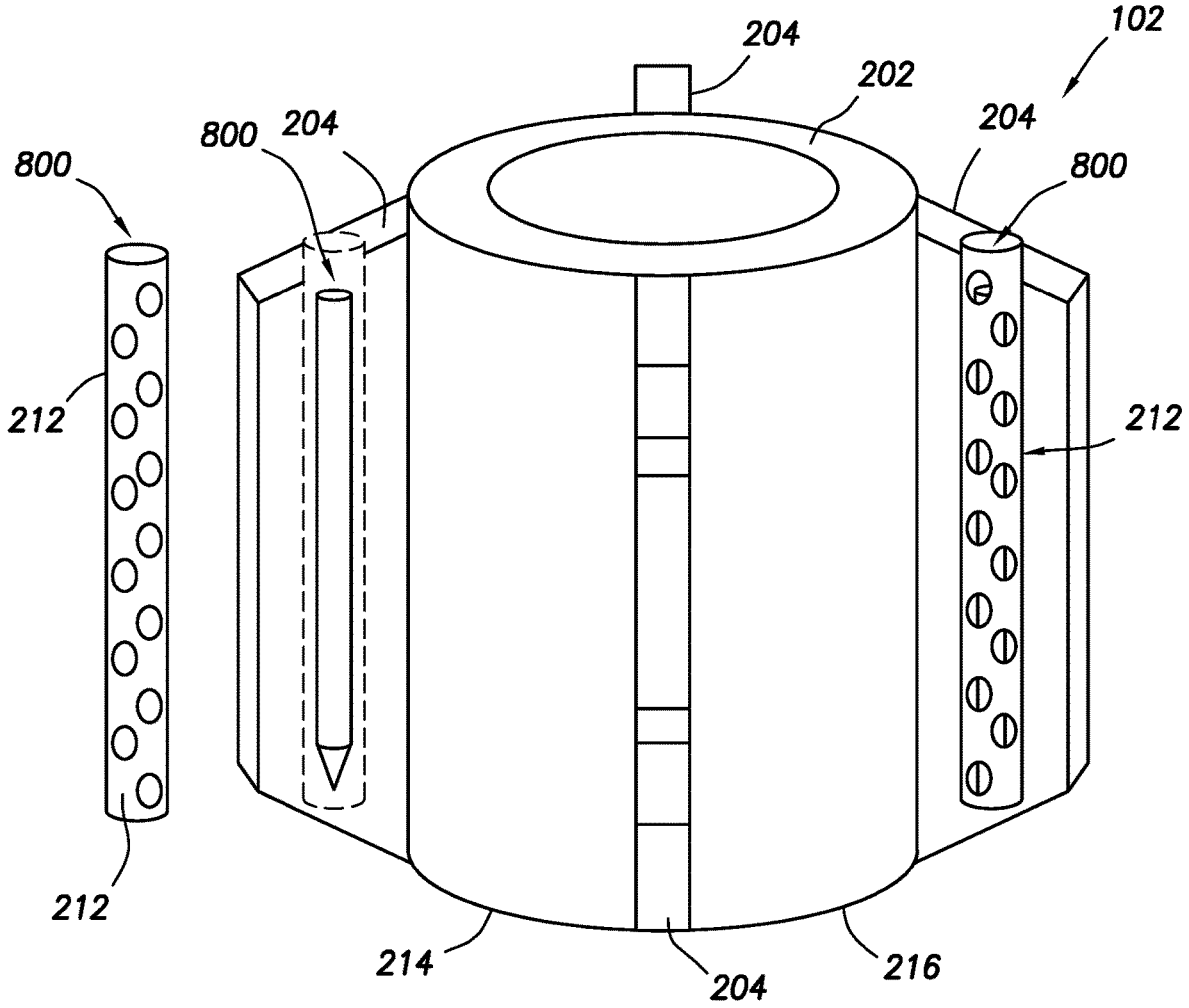
FIG. 8A illustrates a perspective view of an exemplary external support device for attaching to a work string, according to some embodiments of the present disclosure.
Figure 8B:
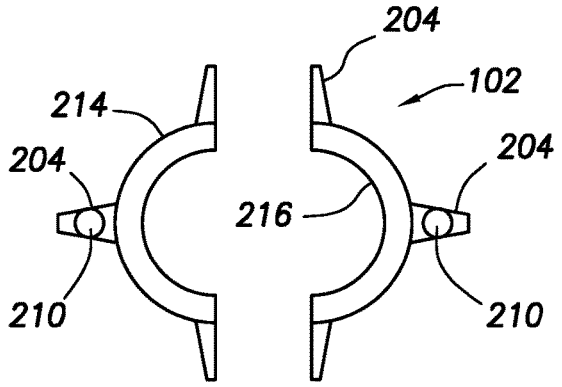
FIGS. 8B and 8C are top views of the external support device of FIG. 8A illustrating how the external support device is coupled to the work string, according to some embodiments of the present disclosure.
Figure 8C:
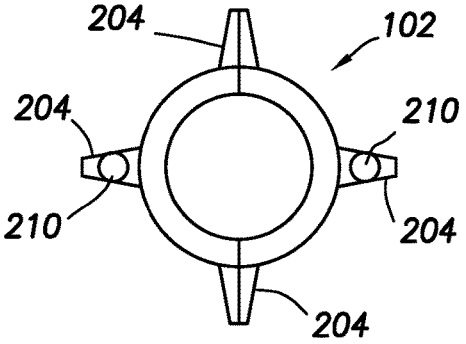

FIG. 8A illustrates a perspective view of an exemplary external support device 102 for attaching to a work string 116 (e.g., FIGS. 1 or FIGS. 5A-C), according to some embodiments of the present disclosure. FIGS. 8B and 8C are top views of the external support device 102 of FIG. 8A illustrating how the external support device 102 is coupled to the work string 116, according to some embodiments of the present disclosure. As depicted, the external support device 102 further includes geophones 800 integrated into the fins 204. While two of the geophones 800 are shown integrated into separate ones of the fins 204, it should be that more or less than two of the geophones 800 may be used. In some embodiments, other data collection devices (not shown) may be integrated into the same (or different) fin 204 with the geophones 800. In addition, while the geophones 800 are shown integrated into the fins, it should be understood that the geophones 800 may be otherwise positioned, for example, coupled to or otherwise integrated in the body 202. As illustrated, the geophones 800 may be disposed in a device housing 212 positioned in the fins 204. The geophones 800 may be attached in a similar manner as described for the data collection devices 210 described above, to provide a means of obtaining distributed seismic profiles, or for augmenting fiber-optic vertical seismic profiling data, relating to wellbore operation. By way of example, the addition of geophones 800 to the external support devices 102 can enable distributed seismic profiling to be performed concurrently with the flow related measurements, as well as provide an additional depth calibration feature to overcome any depth accuracy concerns relative to coiled tubing buckling.

In accordance with some embodiments, the work string 116 may be fiber-optics enabled coiled tubing. Utilizing fiber-optics enabled work string 116 yields the advantage of providing distributed temperature or acoustic measurement along the entire wellbore. In contrast to conventional methods of utilizing fiber-optics, where the fiber-optics are permanently deployed as part of the wellbore for life of the wellbore, embodiments of the present disclosure provides systems and methods for deploying the fiber-optics as part of the work string 116, thereby eliminating the need to stop production operations, or interrupt flow of production fluids during well operation in order to obtain flow data. Where the work string 116 is a fiber-optics enabled work string 116, obtained data may provide an increased confidence factor to flow allocation. In addition, the obtained data may enable proper evaluation of additional flow regimes and flow paths, including axial flow, as well as an accurate means of differentiating between oil and water content of the annular fluid.

FIGS. 8B and 8C illustrate the external support device 102 having hinge-and-locking-pin-type configuration, according to some embodiments of the present disclosure. For securing onto a work string 116, the external support device 102 may be transitioned from an open configuration, illustrated on FIG. 7B, to a closed configuration, illustrated on FIG. 7C. More details on an example hinge-and-locking-pin-type configuration are described above with respect to FIGS. 2A-2C.

FIGS. 8A-8C illustrate the external support device 102 having split-assembly-type configuration, according to some embodiments of the present disclosure. For securing onto a work string 116, the external support device 102 may be transitioned from an open configuration, illustrated on FIG. 8B, to a closed configuration, illustrated on FIG. 8C. More details on an example split-assembly-type configuration are described above with respect to FIGS. 3A-3C. In addition, while the external support device 102 of FIGS. 8A-8C is of the split-assembly-type configuration, it should be understood that the geophones 800 may be used with other configurations of the external support device 102, for example, the geophones 800 may be used with a hinge-and-locking-pin-type configuration as disclosed herein.

Figure 9A:
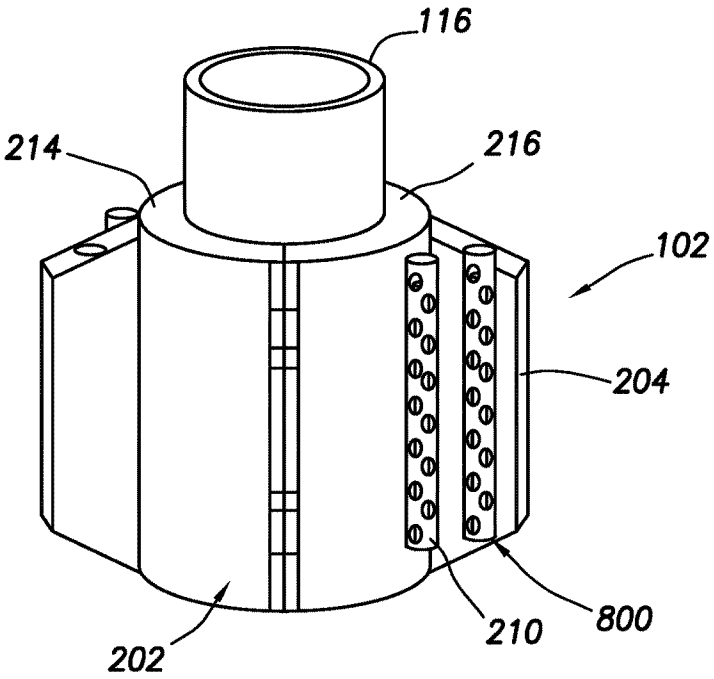
FIG. 9A illustrates a perspective view of an exemplary external support device for attaching to a work string, according to some embodiments of the present disclosure.
Figure 9B:
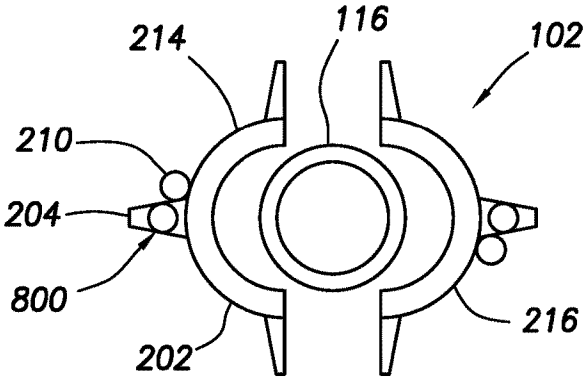
FIGS. 9B and 9C are top views of the external support device of FIG. 9A illustrating how the external support device is coupled to the work string, according to some embodiments of the present disclosure.
Figure 9C:
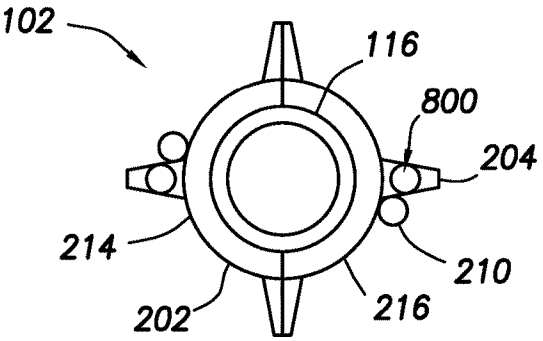

FIG. 9A illustrates a perspective view of an exemplary external support device 102 for attaching to a work string 116, according to some embodiments of the present disclosure. FIGS. 9B and 9C are top views of the external support device of FIG. 9A illustrating how the external support device 102 is coupled to the work string 116, according to some embodiments of the present disclosure. Similar to the configuration discussed above with respect to FIG. 8A, the work string 116 may be a fiber-optics enabled work string 116. Similar to the configuration of FIG. 8A, the external support device 802 may have a split-assembly-type configuration. However, in the embodiments of FIGS. 9A to 9C, the external support device 102 may include geophones 800 integrated into the fins 204 and data collection devices 210 coupled to (or otherwise integrated in) the body 202 of the external support device 102. In some embodiments, however, both the data collection devices 210 and the geophone 800 may all be integrated into the body 202 or into one or more of the fins 204. In addition, while the external support device 102 of FIGS. 9A-9C is of the split-assembly-type configuration, it should be understood that the geophones 800 and data collection devices 210 may be used with other configurations of the external support device 102, for example, with a hinge-and-locking-pin-type configuration as disclosed herein.

Figure 10:
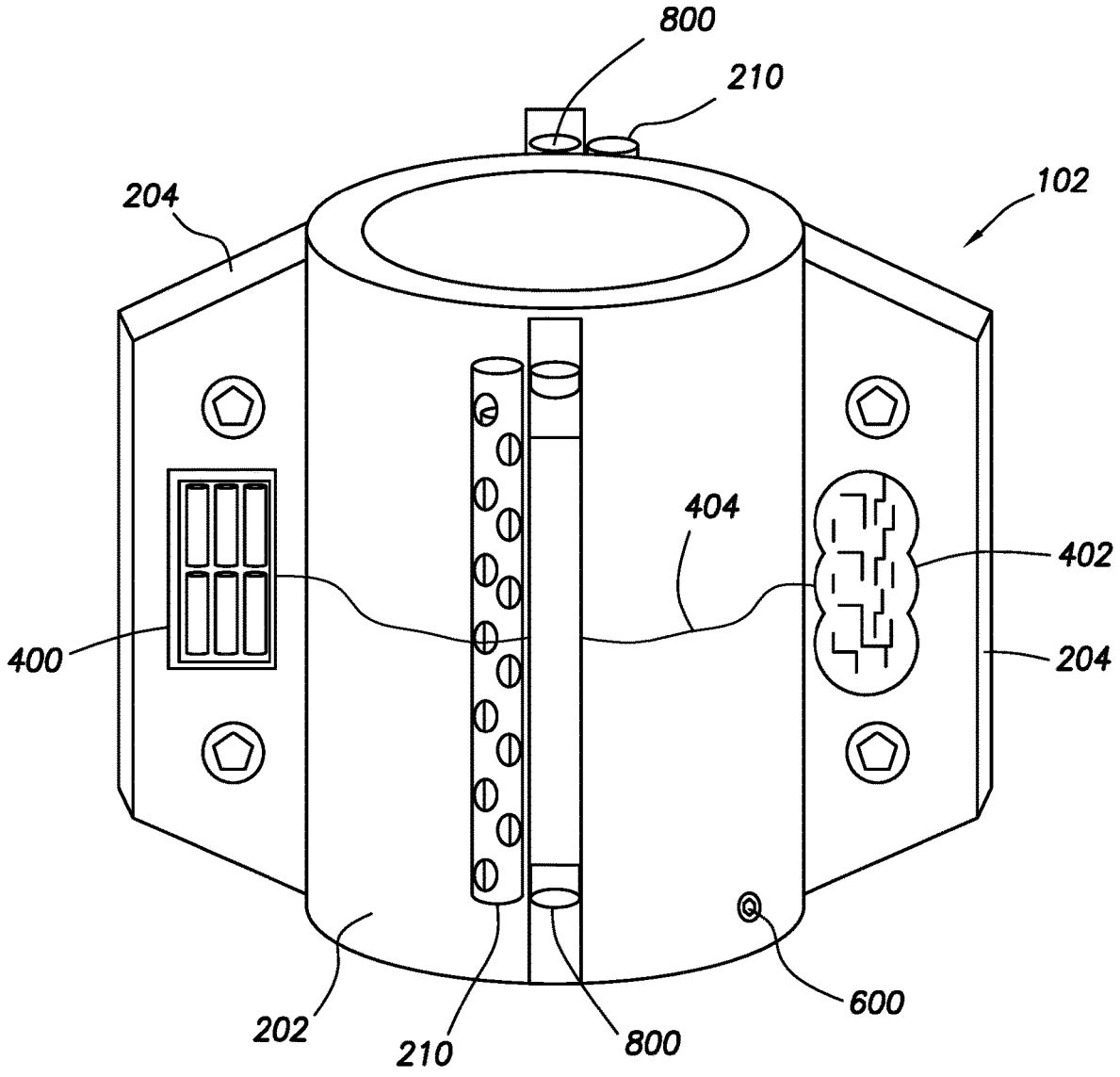
FIG. 10 illustrates a perspective side view of the external support device of FIG. 9A rotated 90 degrees, according to some embodiments of the present disclosure.

FIG. 10 illustrates a perspective side view of the external support device 102 of FIG. 9A rotated 90 degrees, according to some embodiments of the present disclosure. As illustrated, the external support device further includes a battery module 400 positioned or integrated at least partially into one of the fins 204 of the external support device 102, and a circuit board 402 integrated into another of the fins 204. The battery module 400 and circuit board 402 may be positioned and configured, for example, as described above with respect to FIG. 4. As illustrated, each of the battery module 400 and the circuit board 402 may be connected to the data collection devices 210 and the geophones 800 with a connection line 404 so as to provide power and receive information therefrom, respectively. In alternate embodiments, each of the fins 204 (or the body 202) may have more than one component selected from the data collection devices 210, the geophones 800, the battery module 400 and the circuit board 402 integrated therein. Each of the aforementioned components is of such small size that conceivably each of the data collection devices 210, the geophones 800, the battery module 400, and the circuit board 402 may be positioned on one or more of the fins 204 (or body 202). As illustrated, the data collection devices 210, the geophones 800, the battery module 400, and the circuit board 402 have been segregated in FIG. 10 for clarity only. In some embodiments, all fins 204 may contain data collection devices 210, the geophones 800, the battery module 400, and the circuit board 402 as needed.

As depicted, the external support device 102 further includes an optional locking screw 600 to hold the external support device 102 further in place on the fiber-optics enabled work string 116 and prevent the external support device 102 further from being displaced longitudinally along the work string 116. In other embodiments, the external support device 102 further may be held in place with a gasket seal, a slip face, a back-up clamp, or some other means of preventing the external support device 102 further from sliding out of position.

Figure 11A:
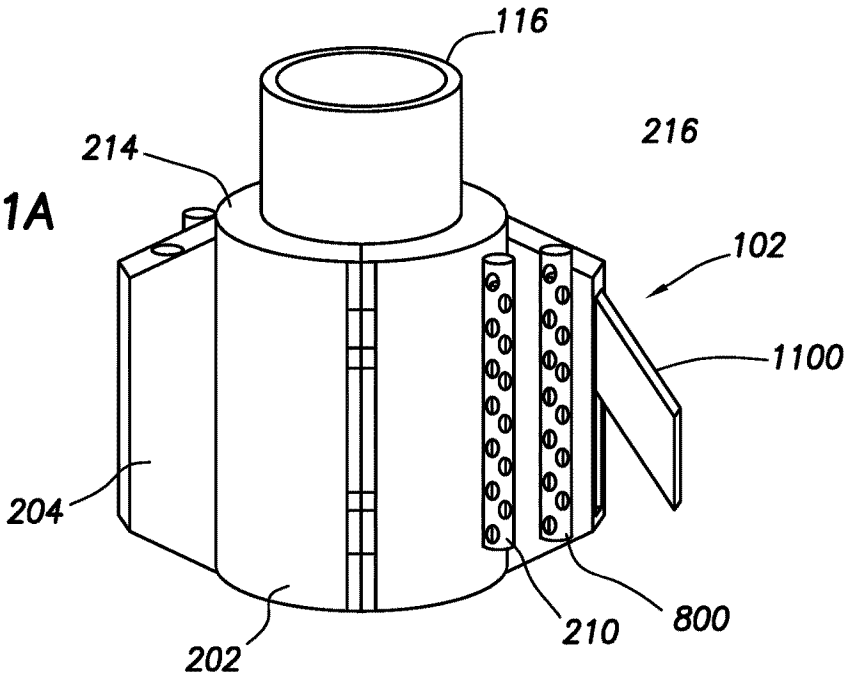
FIG. 11A illustrates a perspective view of an exemplary external support device coupled to a work string, according to some embodiments of the present disclosure.
Figure 11C:
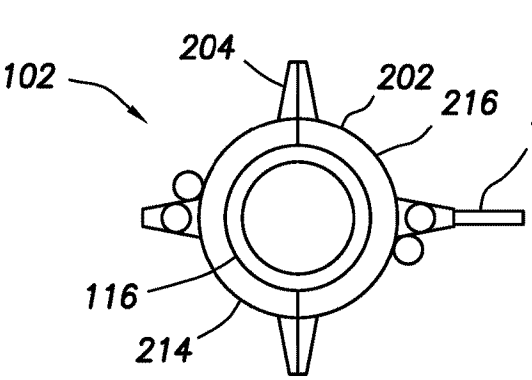
FIGS. 11B and 11C are top views of the external support device of FIG. 11A illustrating how the external support device is coupled to the work string, according to some embodiments of the present disclosure.
Figure 11B:
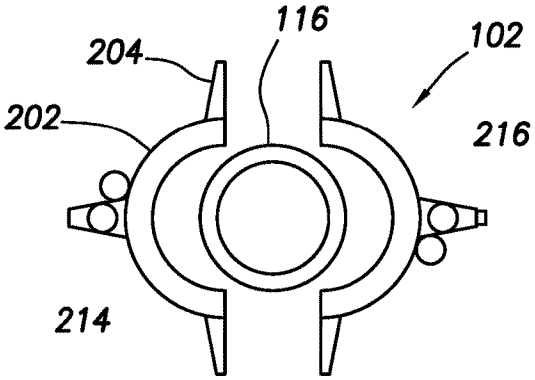

FIG. 11A illustrates a perspective view of an exemplary external support device 102 coupled to a work string 116, according to some embodiments of the present disclosure. FIGS. 11B and 11C are top views of the external support device 1102 of FIG. 11A illustrating how the external support device 102 is coupled to the work string 116, according to some embodiments of the present disclosure. As illustrated, the external support device 102 is similar to the external support device of FIG. 10A, but further includes an optional armature 1100 for use where the inner diameter of the wellbore is significantly larger than the outer diameter of the external support device 102 defined by the extent of radial protrusion of the fins 204 from the body 202 of the external support device 102. The armature 1100 may be extendable way from the fins and advantageous in facilitating coupling of the geophones 800 with the casing/wellbore wall, for example, where the fins 204 do not extend all the way to the casing/wellbore wall. In these embodiments, the armature 1100 acts as an extension of the fins 204 to contact the casing/wellbore wall for the geophones 800 to be able to sense vibrations or other seismic activity downhole. In addition, while the external support device 102 of FIGS. 11A-11C is of the split-assembly-type configuration, it should be understood that the armature 1100 may be used with other configurations of the external support device 102, for example, with a hinge-and-locking-pin-type configuration as disclosed herein.

Figure 12:
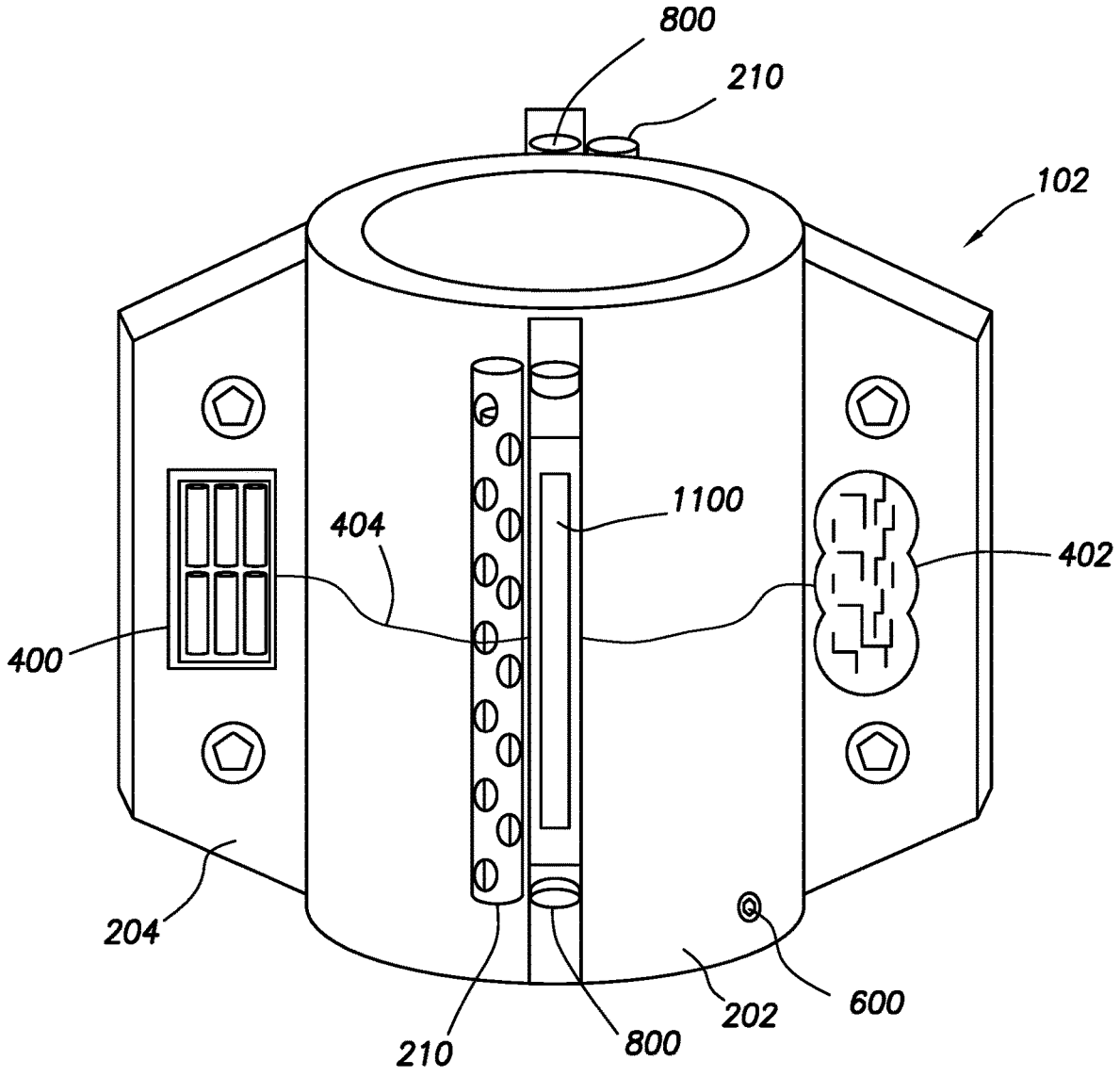
FIG. 12 illustrates a perspective side view of the external support device of FIG. 11A rotated 90 degrees, according to some embodiments of the present disclosure.

FIG. 12 illustrates a perspective side view of the external support device 102, rotated 90 degrees, of FIG. 11A with optional armature 1110, according to some embodiments of the present disclosure. Similar to the configuration of the external support device 102 of FIG. 10, the external support device 102 further includes a battery module 400 positioned or integrated at least partially into one of the fins 204 of the external support device 102, and a circuit board 402 integrated into another of the fins 200. The battery module 400 and circuit board 402 may be positioned and configured, for example, as described above with respect to FIG. 4. As illustrated, each of the battery module 400 and the circuit board 402 may be connected to the data collection devices 210 and the geophones 800 with a connection line 404 so as to provide power and receive information therefrom, respectively. In alternate embodiments, each of the fins 204 (or the body 202) may have more than one component selected from the data collection devices 210, the geophones 800, the battery module 400 and the circuit board 402 integrated therein. Each of the aforementioned components is of such small size that conceivably each of the data collection devices 210, the geophones 800, the battery module 400, and the circuit board 402 may be positioned on one or more of the fins 204 (or body 202). As illustrated, the data collection devices 210, the geophones 800, the battery module 400, and the circuit board 402 have been segregated in FIG. 10 for clarity only. In some embodiments, all fins 204 may contain data collection devices 210, the geophones 800, the battery module 400, and the circuit board 402 as needed.

As depicted, the external support device 102 further includes an optional locking screw 600 to hold the external support device 102 further in place on the fiber-optics enabled work string 116 and prevent the external support device 102 further from being displaced longitudinally along the work string 116. In other embodiments, the external support device 102 further may be held in place with a gasket seal, a slip face, a back-up clamp, or some other means of preventing the external support device 102 further from sliding out of position.

The aforementioned configurations combining the geophones 800 on an external support device 102 coupled to a work string 116 that is fiber-optics enabled provides a system advantageously combining the X, Y, Z space directionality of the geophones 800 at specific points in the wellbore with the high resolution of the fiber-optics data.

Figure 13:
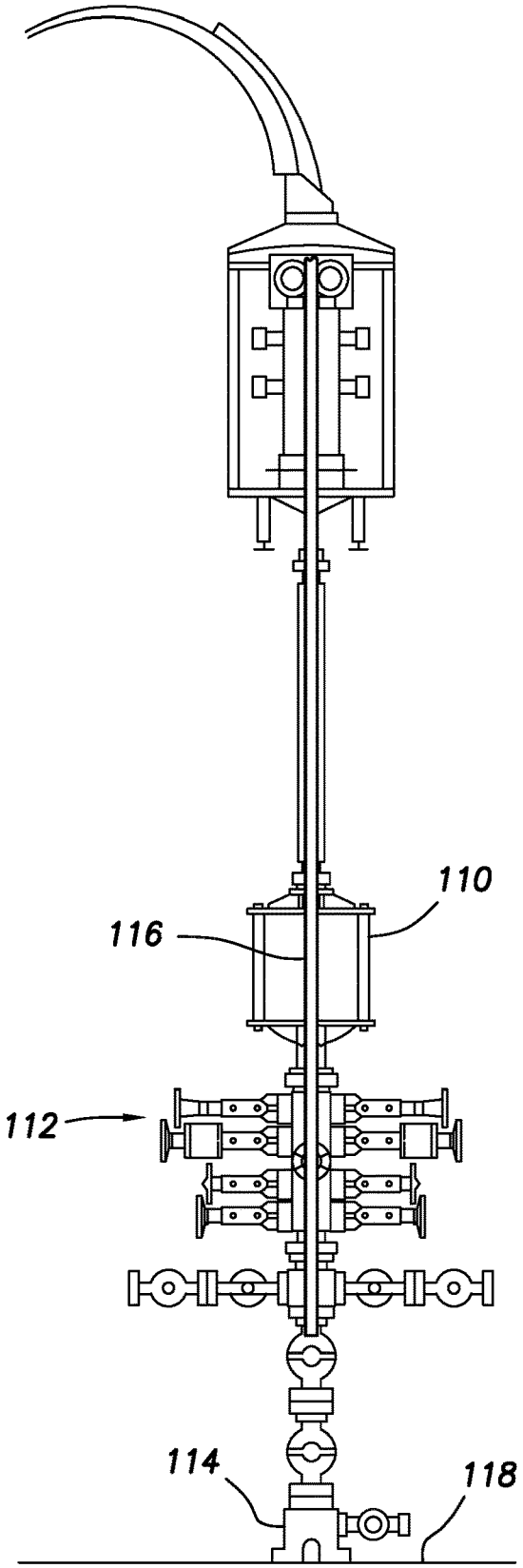
FIGS. 13-16 illustrate a method of coupling a first external support device to a work string, according to some embodiments of the present disclosure.
Figure 14:
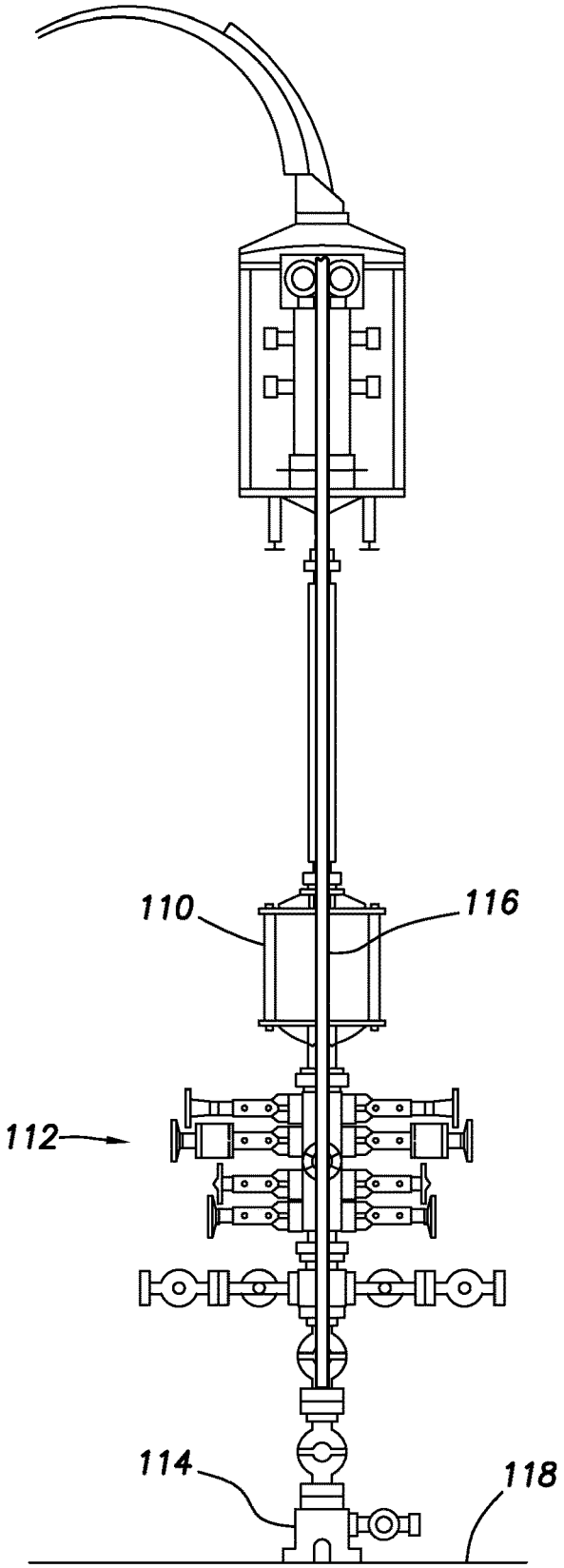
Figure 15:
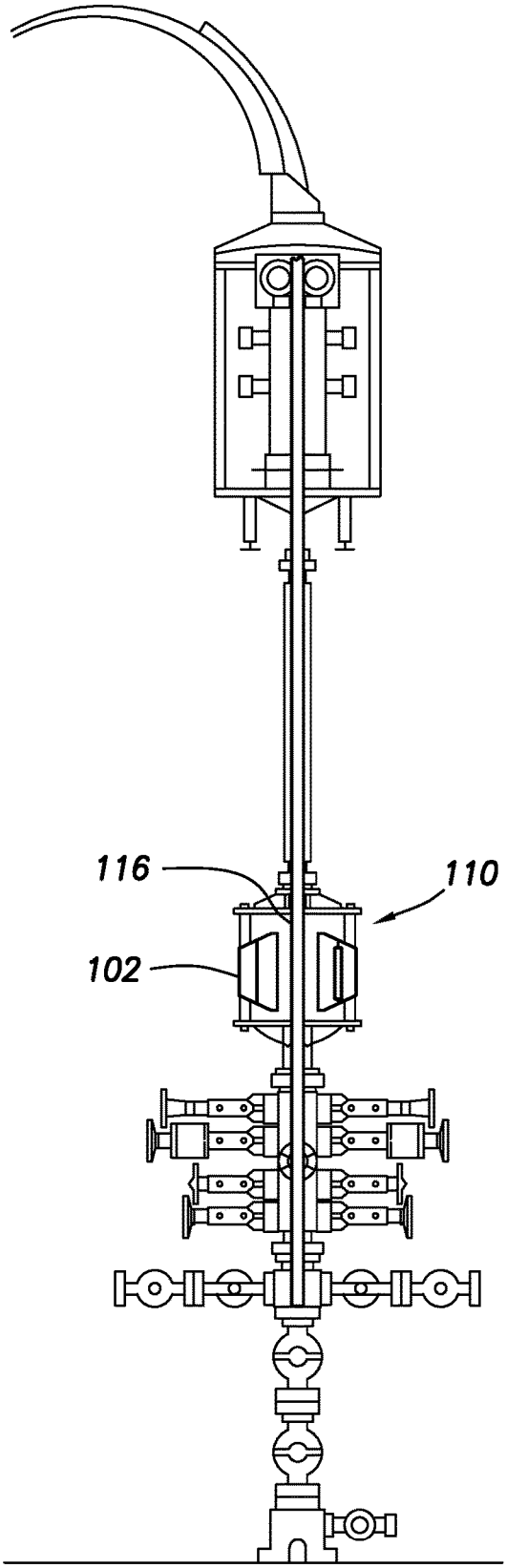
Figure 16:
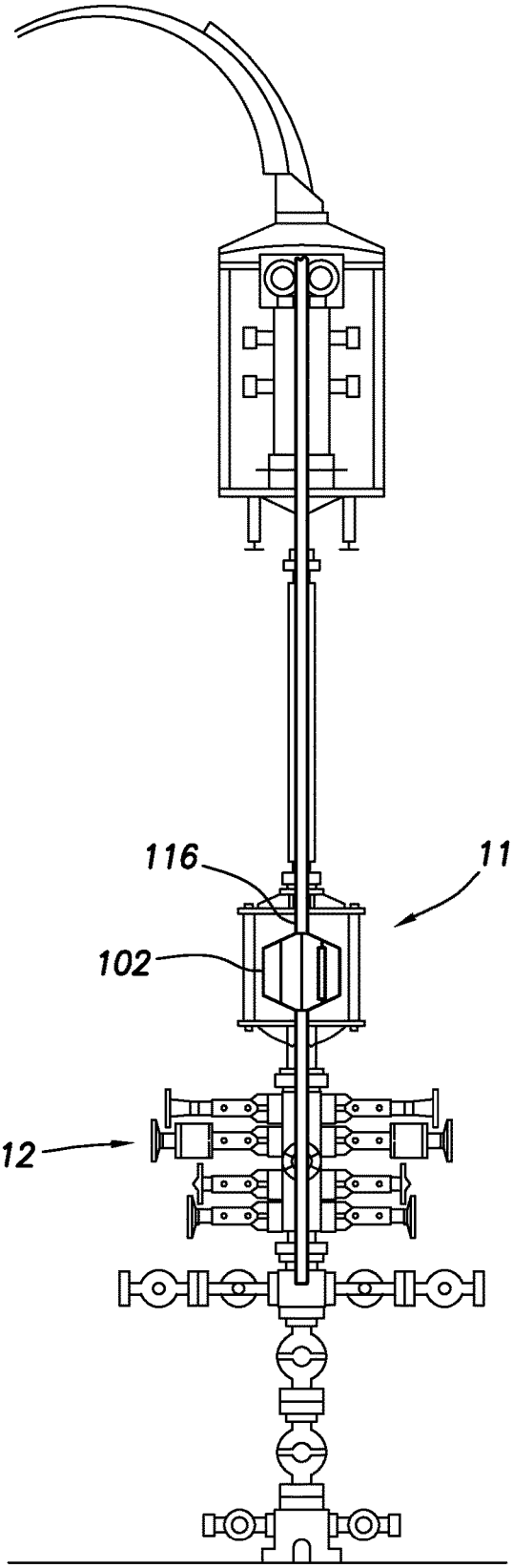

FIGS. 13-16 illustrate a method of coupling an external support device 102 to a work string 116, according to some embodiments of the present disclosure. As illustrated in FIG. 13, the method may include the steps of running the work string 116 downhole through the wellhead 114 to a desired location. The desired location may correspond to a first position above surface 118 which is aligned with the work window 110, where the external support device 102 will be coupled to the work string 116. Embodiments of the method may further includes closing BOP 112 pipe seals, bleeding off pressure above the BOP 112, and opening the work window 110, as illustrated in FIG. 14. Once the work window 110 is open, an external support device 102 may be coupled to the work string 116 through the work window 110, according to the various embodiments described herein, and as illustrated in FIG. 15. Once the external support device 102 is coupled or otherwise attached to the work string 116, the work window 110 may be closed, pressure above and below the BOP 112 may be equalized, and the BOP 112 seal rams may be opened, as illustrated in FIG. 16.

Figure 17:
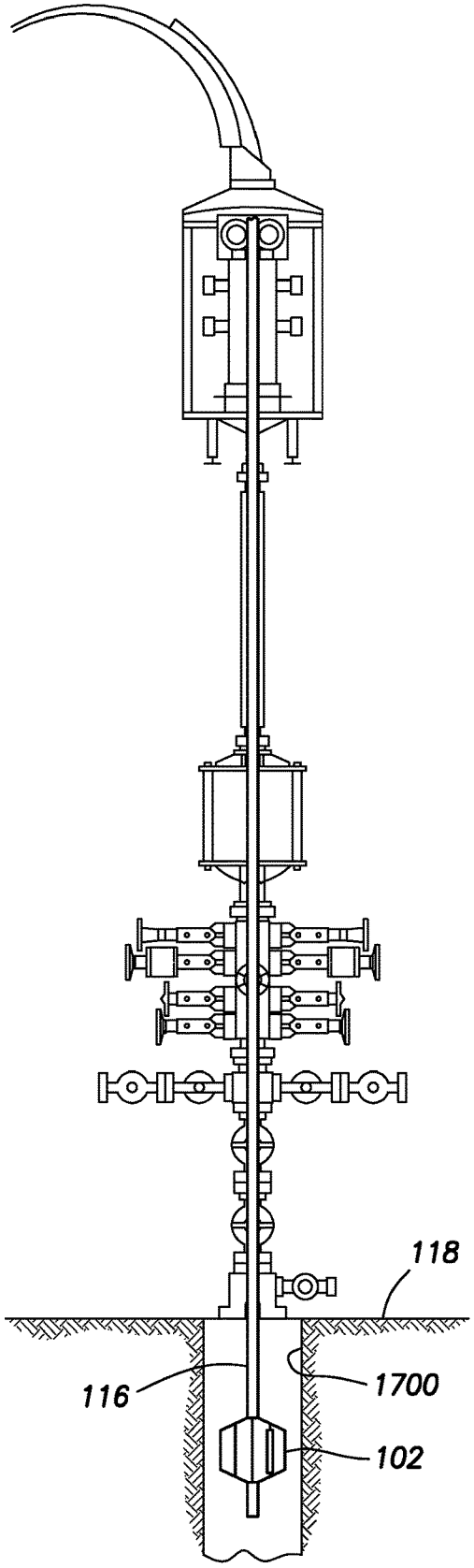
FIG. 17 illustrates the external support device of FIGS. 13-16 on the work string being run into a wellbore, according to some embodiments of the present disclosure.

FIG. 17 illustrates the external support device 102 of FIGS. 13-16 on the work string 116 being run into a wellbore 1700 below surface 118 according to some embodiments of the present disclosure. As illustrated in FIG. 17, the method may further include running the external support device 102 having the data collection devices 210 (e.g., shown on FIGS. 2A-2C) integrated thereon downhole into wellbore 1700 to a desired location. The desired location may correspond to a position on the work string 116 above the surface 118 to which an additional external support device 1800 shall be coupled, the position being aligned with the work window, as shown on FIG. 18.

Figure 18:
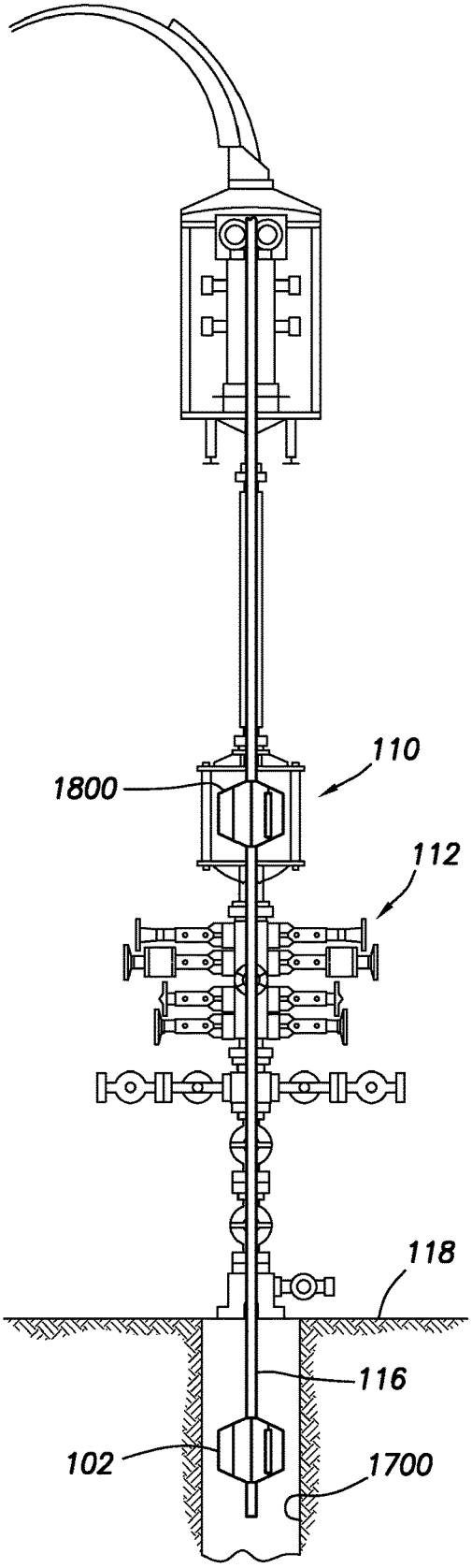
FIG. 18 illustrates coupling of a second external support device to the work string once the first external support device has reached a desired depth in the wellbore, according to some embodiments of the present disclosure.

FIG. 18 illustrates coupling of an additional external support device 1800 to the work string 116 once the external support device 102 has reached a desired location in the wellbore 1700, according to some embodiments of the present disclosure. The method may further include repeating closing of the BOP 112 pipe seals, bleeding off pressure above the BOP 112, and opening the work window 110. Once the work window 110 is open, the additional external support device 1800 may be coupled to the working string 116 through the work window 110, according to the various embodiments described herein, and as illustrated in FIG. 18. Once the additional external support device 1800 is coupled or otherwise attached to the work string 116, in some embodiments, the process steps of closing the work window 110, equalizing pressure above and below the BOP 112 , and opening the BOP 112 seal rams may be repeated.

Figure 19:
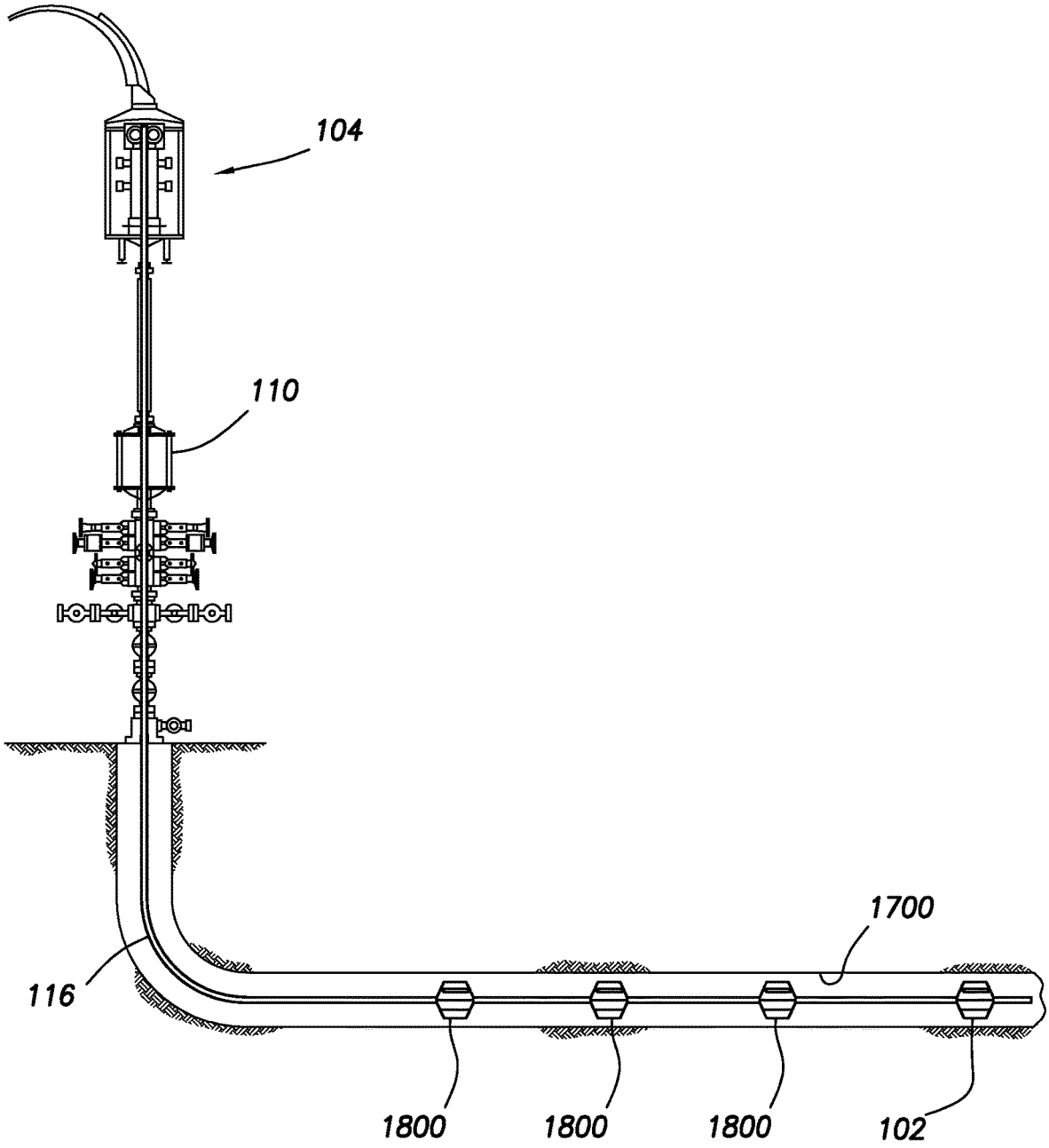
FIG. 19 illustrates running a plurality of external support devices into the wellbore to at a plurality of desired positions to measure and collect flow data at the plurality of desired depths (or lateral positions in a horizontal wellbore), according to some embodiments of the present disclosure.

FIG. 19 illustrates running a plurality of external support devices, including external support device 102 and additional external support devices 1800 into the wellbore 1700 on work string 116 to at a plurality of locations (e.g., desired depths or positions in a horizontal wellbore), for example, to measure and collect flow data at the plurality of desired locations, according to some embodiments of the present disclosure. As illustrated in FIG. 19, the method may further include repeating the steps illustrated in FIGS. 13-18 until a plurality of additional external support devices 1800, are positioned at desired locations in the wellbore 1700. When production fluids are flowing in the wellbore 1700, the method may further include recording or collecting measurement data using the data collection devices 210, described herein, for the duration of the run. When the run is complete, the work string 116 may be pulled out of the wellbore 1700. The external support device 102 and additional external support devices 1800 may then then sequentially positioned in the work window 110 and removed for further processing of the measured/recorded data.

In alternate embodiments, the need for a work window 110 may be eliminated. That is, the injector 104 may drive the work string 116 in a desired direction to expose an access point on the work string 116 where each external support device 102 may be directly attached.

Figure 20:
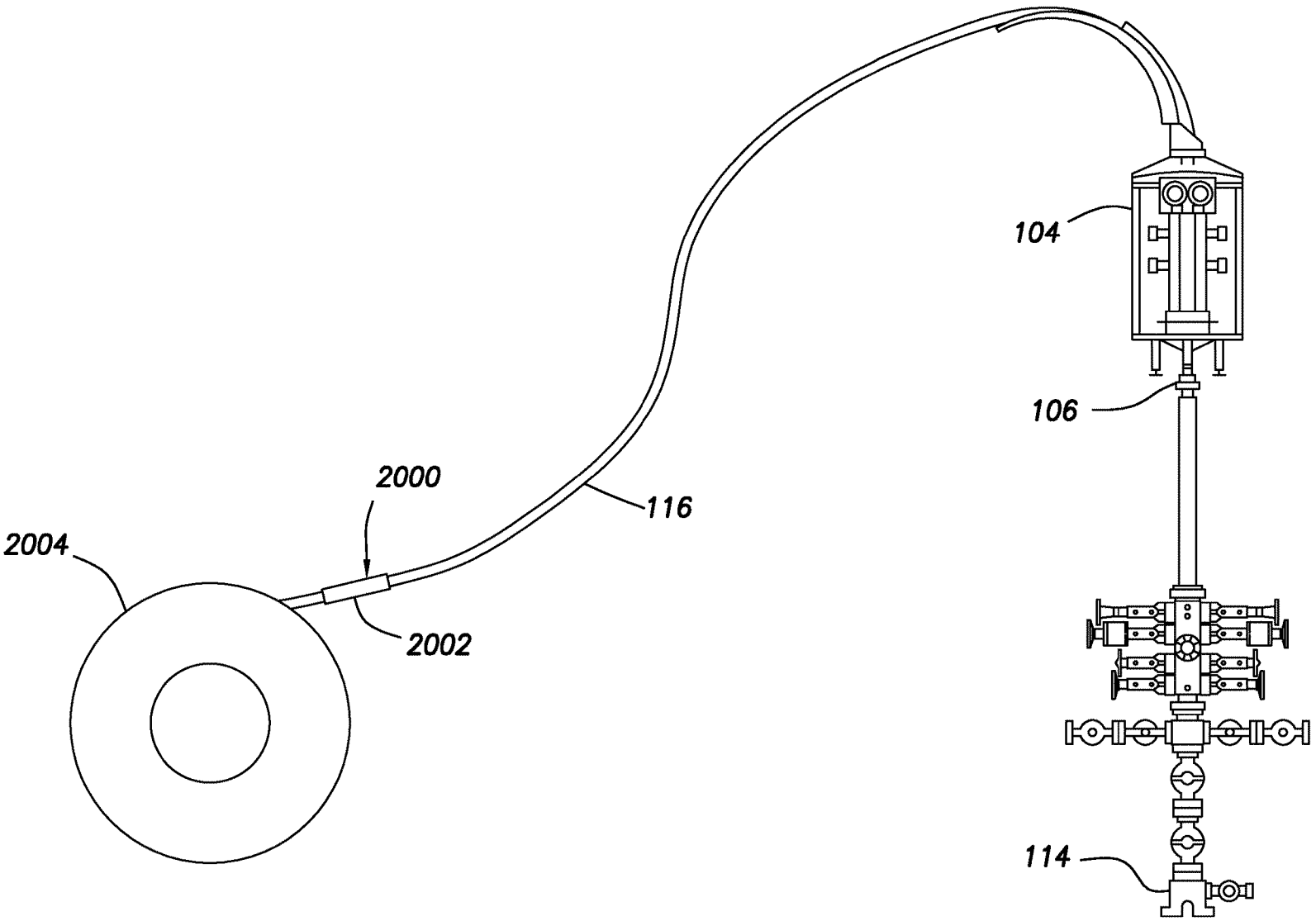
FIG. 20 illustrates another exemplary system for coupling an external support device to the work string, according to some embodiments of the present disclosure.

FIG. 20 illustrates another exemplary system for coupling an external support device 2000 to the work string 116, according to some embodiments of the present disclosure. As illustrated in FIG. 20, the external support device 2000 may take the form of a lighter weight and even smaller assembly, e.g., a strip 2002 of material that may be thin and durable. The strip 2002 may be wrapped around and adhered directly to the work string 116. To this effect, the data collection devices 210 and other components may be housed inside of the strip 2002. In some embodiments, the strip 2002 may take the form of a layer of paint. In the illustrated embodiments, the external support device 2000 takes the form of a strip 2002 or any other suitable material that can be stuck directly to the work string 116 to remove the need for having a work window 110 (e.g., shown on FIG. 1). The aforementioned configuration yields the advantage of providing an external support device 2000 which is small enough in size to be run through the stripper 106, thereby allowing the external support device to be attached to the work string 102 at a point after leaving a reel 2004 and before entering the injector 104.

Figure 21:
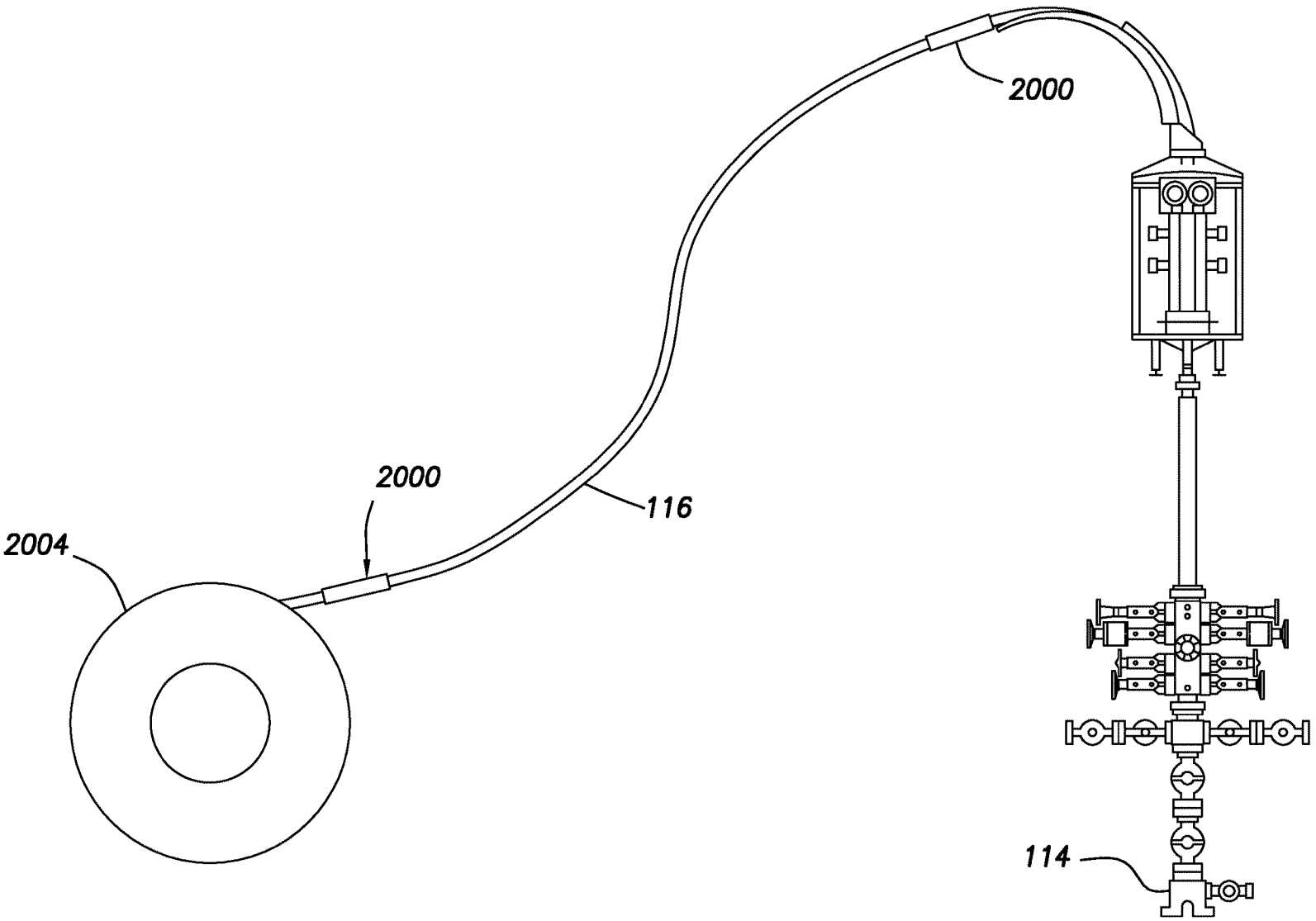
FIGS. 21 and 22 illustrate a method of coupling a plurality of the external support devices of FIG. 20 to a work string and running the external support devices into the wellbore to at a plurality of positions (e.g., desired depths, lateral positions in a horizontal wellbore, etc.), to measure and collect flow data at the plurality of positions, according to some embodiments of the present disclosure.
Figure 22:
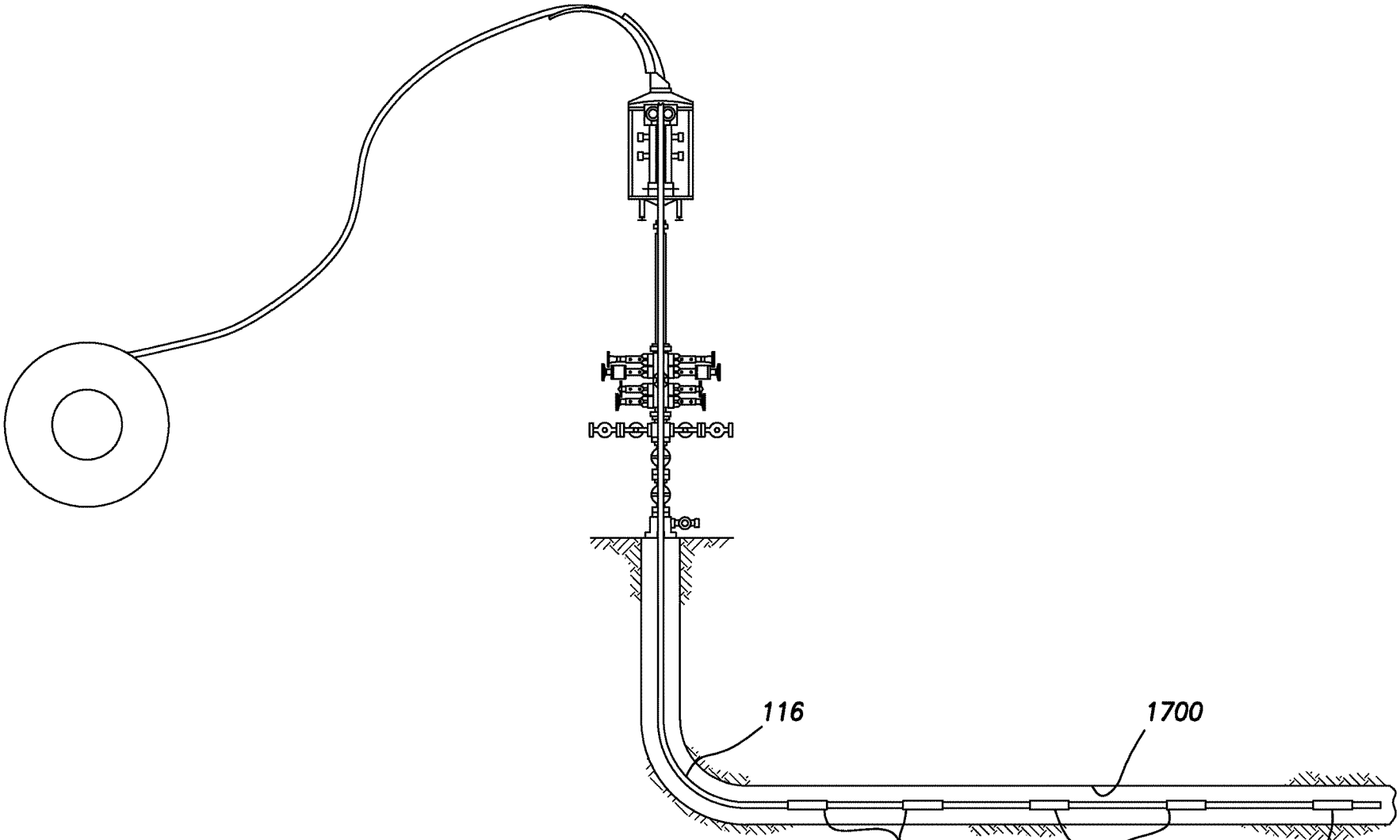

FIGS. 21 and 22 illustrate a method of coupling a plurality of the external support devices 2000 as described with respect to FIG. 20 to a work string 116 and running the work string 116 into the wellbore 1700 to at a plurality of desired positions, for example, to measure and collect flow data at the plurality of desired locations (e.g., depths and/or lateral positions in a horizontal wellbore), according to some embodiments of the present disclosure. The method may include running the work string 116 downhole until a target data collection point on the work string 116 is at the level wind on the reel, and affixing one of the external support devices 2000, for example, by either taping or painting onto the work string 116 as illustrated in FIG. 20. After the first of external support devices 2000 is attached to the work string 116 at the reel 2004, the work string 116 may be further run downhole through wellhead until a next target data collection point on the work string 116 is reached. As illustrated in FIGS. 21, the method further includes affixing one or more additional external support devices 2000, for example, by either taping or painting onto the work string 116 similar to the first of the external support device 2000, and repeating this process for subsequent ones of the external support devices 2000. Once the desired number of external support devices 2000 have been affixed to the work string, the method further includes running the work string 116 with the plurality of external support devices 2000 into the wellbore 1700 to measure and collect flow data at a plurality of desired depths (or lateral positions in a horizontal wellbore), as shown on FIG. 22. When production fluids are flowing in the wellbore 1700, embodiments of the method may further include recording or collecting measurement data using the data collection devices (e.g., shown on FIGS. 2A-2C), described herein, for the duration of the run. When the run is complete, the work string 116 may be pulled out of the wellbore 1700. The external support devices 2000 may then be sequentially removed from the work string 116 for further processing of the measured/recorded data.

The systems and methods of the present disclosure as described herein may provide several advantages over conventional systems and methods of data gathering in the wellbore. For example, listed advantages include, but are not limited to (1) reliable application of flow meters and fluid evaluation tools to any well; (2) enhancement of production profiles, including jobs on fiber; (3) enhanced and improved characterization of distributed axial flow; (4) capability of performing distributed resistivity and flow logging, rather than point data related only to bottomhole assembly position; and/or (5) addition of geophones to the external support devices may enable additional distributed seismic diagnostics with the ability to perform concurrent measurements of axial flow conditions downhole.

The systems and methods of the present disclosure may include any of the various features disclosed herein, including one or more of the following statements.

Statement 1: A system may be provided that includes a work string, an external support device secured to an exterior of the work string, and at least one data collection device coupled to the external support device.

Statement 2: The system of statement 1, wherein the external support device is in a form of a strip disposed on the work string.

Statement 3: The system of statement 1 or 2, wherein the work string includes a pipe string or coiled tubing.

Statement 4: The system of any preceding statement, wherein the system further includes a fiber-optic cable coupled to the work string and running along the work string.

Statement 5: The system of any preceding statement, wherein the at least one data collection device includes at least one device selected from the group consisting of a resistivity gauge, a pressure gauge, a temperature gauge, a flow meter, a sensor, and any combination thereof, and wherein the at least one data collection device further includes a geophone.

Statement 6: The system of any preceding statement, wherein the external support device includes: a body, wherein the body defines a central opening through which the work string is disposed; and stabilizers that extend outwardly from an outer surface of the body.

Statement 7: The system of statement 6, wherein the external support device includes a first portion and a second portion joined at a hinged connection, wherein the external support device has an open configuration and a closed configuration, wherein the body defines the central opening in the closed configuration such that the external support device is concentrically disposed at least partially around a portion of the work string.

Statement 8: The system of statement 6, wherein the external support device is formed of a first portion and a second portion which are coupled to one another to form external support device, and wherein fasteners are secured through opposing pairs of stabilizers to secure the first portion and the second portion to one another.

Statement 9: The system of any one of statements 6 to 8, wherein the external support device includes a memory module and a battery module, wherein the battery module is coupled to the at least one data collection device for supplying power, and wherein the memory module is coupled to the at least one data collection device for receiving and storing measurements.

Statement 10: The system of any one of statements 6 to 9, wherein the at least one data collection device is disposed in one of the stabilizers.

Statement 11: The system of any one of statements 6 to 10, wherein the stabilizers include fins that extend radially from the outer surface of the body.

Statement 12: The system of statement 6, wherein the stabilizers include fins that radially project from an outer surface of the body, wherein the at least one data collection device includes a geophone disposed in at least one of the fins, wherein the at least one data collection device includes a sensor for flow rate detection coupled to or integrated into the body or at least one of the fins, wherein the external support device further includes a memory module integrated into one of the fins and a battery module integrated into one of the fins, wherein the battery module is coupled to the at least one data collection device for supplying power, and wherein the memory module is coupled to the at least one data collection device for receiving and storing measurements, wherein the memory module, the battery module, the geophone, and/or the sensor are disposed in a same or a different one of the fins, and wherein the system further includes a fiber-optic cable coupled to the work string and running along the work string.

Statement 13: The system of any preceding statement, wherein two or more of the external support device are disposed at spaced locations along the work string.

Statement 14: The system of any preceding statement, further including a reel on which the work string is partially disposed. The statement further includes an injector including a drive chain assembly arranged to grip the work string and run the work string into and out of a wellbore. The statement further includes a stripper mounted on the injector to provide a hydraulic seal around the work string. The statement further includes a lubricator in a form of a tube arranged to receive the work string from the stripper and contain the work string under pressure. The statement further includes a blowout preventer installed at a wellhead that receives the work string from the lubricator, wherein the blow out preventer includes blades for cutting the work string when activated and rams for sealing around the work string when activated. The statement further includes a work window installed above the blowout preventer through which the external support device is installed on the work string.

Statement 15: An apparatus is provided that includes an external support device. The external support device may include a body, wherein the body defines a central opening for receiving a work string. The external support device may further include stabilizers that extend outwardly from an outer surface of the body. The apparatus may further include at least one data collection device coupled to the body.

Statement 16: The apparatus of statement 15, wherein the external support device includes a first portion and a second portion, wherein the external support device has an open configuration and a closed configuration, wherein the body defines the central opening in the closed configuration such that the external support device is concentrically disposed around at least a portion of the work string, wherein the first portion and the second portion are formed at a hinged connection and/or wherein fasteners are secured through opposing pairs of stabilizers to secure the first portion and the second portion to one another.

Statement 17: The apparatus of statement 15 or 16, wherein the external support device includes a memory module and a battery module, wherein the battery module is coupled to the at least one data collection device for supplying power, and wherein the memory module is coupled to the at least one data collection device for receiving and storing measurements.

Statement 18: The apparatus of any one of statements 15 to 17, wherein the at least one data collection device is disposed in one of the stabilizers.

Statement 19: The apparatus of any one of statements 15 to 18, wherein the at least one data collection device includes a geophone disposed in at least one of the stabilizers, wherein the at least one data collection device includes a sensor for flow rate detection coupled to or integrated into the body or at least one of the stabilizers.

Statement 20: The apparatus of any one of statements 15 to 19, wherein the stabilizers include fins that extend radially from the outer surface of the body.

Statement 21: The apparatus of any one of statements 15 to 20, further including a sample chamber integrated into at least one of the stabilizers.

Statement 22: A method of flow measurement in a wellbore is provided. The method may include coupling an external support device to a portion of a work string, wherein the external support device carries at least one data collection device on the work string. The method may further include running the work string into the wellbore. The method may further include obtaining flow data with the data collection device in the wellbore.

Statement 23: The method of statement 22, wherein coupling the external support device to the portion of the work string includes painting the external support device onto the portion of the work string.

Statement 24: The method of statement 22 or 23, further including coupling one or more additional external support devices to the work string at spaced apart locations, wherein the additional external support devices each support respective data collection devices.

Statement 25: The method of any one of statements 22 to 24, wherein the external support device further carries at least one geophone, and wherein the method further includes taking one or more measurements with the geophone in the wellbore.

Statement 26: The method of any one of statements 22 to 25, further including running a fiber-optic cable into the wellbore with the work string, obtaining data from distributed acoustic sensing and/or distributed temperature sensing with the fiber-optic cable, and combining the data with the flow data.

Accordingly, the various embodiments of methods and systems for characterizing axial flow as described herein may provide the advantages of measuring flow conditions in the wellbore, in addition to differentiation between the presence of water and hydrocarbons. Additionally, the various devices described herein may be designed as a temporary deployment option, as opposed to a permanent completion, thereby providing total customization on the fly in terms of the depth or placement of the measurement components. The aforementioned configuration may lend the ability to for the measurement devices and components described herein to be deployed at any time throughout the life cycle of the well. Furthermore, in contrast to conventional measurement devices and systems, the methods and systems of the various embodiments of the present disclosure do not require zonal isolation to provide useful data.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. An apparatus for flow measurement in a wellbore, comprising:

an external support device including a body configured for removably securing at any of a plurality of locations to an exterior of a work string for running into the wellbore;

one or more stabilizers that extend outwardly from the body;

a flow sensor coupled to the body operable to measure annular flow between the work string and the wellbore;

a memory module coupled to the external support device for storing measurements of the annular flow from the flow sensor; and a battery module coupled to the external support device for supplying power to one or both of the flow sensor and the memory module.

2. The apparatus of claim 1, wherein the external support device comprises a first portion and a second portion, wherein the external support device has an open configuration and a closed configuration, wherein the body defines the central opening in the closed configuration such that the external support device is concentrically disposed around at least a portion of the work string.

3. The apparatus of claim 2, wherein the first portion and the second portion are joined at a hinged connection.

4. The apparatus of claim 2, wherein fasteners are secured through opposing pairs of the stabilizers to secure the first portion and the second portion to one another.

5. The apparatus of claim 1, wherein the at least one flow sensor is disposed in one of the stabilizers.

6. The apparatus of claim 1, wherein the work string comprises coiled tubing.

7. The apparatus of claim 1, wherein the memory module is disposed on a circuit board that is integrated into one of the stabilizers.

8. The apparatus of claim 1, further comprising a geophone disposed in at least one of the stabilizers for obtaining distributed seismic profiles.

9. The apparatus of claim 1, wherein the stabilizers comprise fins that extend radially from the outer surface of the body.

10. The apparatus of claim 1, further comprising a sample chamber integrated into at least one of the stabilizers.

11. A system for flow in a wellbore, comprising:

a work string configured for running into the wellbore;

a plurality of apparatuses removably secured to an exterior of the work string at spaced apart locations, wherein each of the plurality of apparatuses has an external support device including a body, wherein the body defines a central opening through which the work string extends, and one or more stabilizers that extend outwardly from an outer surface of the body, and at least one flow sensor coupled to the body operable to measure annular flow between the work string and a larger conduit or a wellbore wall, a memory module coupled to the external support device for storing measurements of the annular flow from the at least one flow sensor, and a battery module carried by the external support device, wherein the battery module is coupled to the external support device for supplying power.

12. The system of claim 11, wherein the work string comprises coiled tubing, and wherein the stabilizers comprise fins that extend radially from the outer surface of the body.

13. The system of claim 11, wherein the system further comprises a fiber-optic cable coupled to the work string and running along the work string, wherein the system further comprises a processor operable to correlate data from the fiber-optic cable with the measurements of the annular flow.

14. The system of claim 11, wherein the at least one flow sensor is disposed in one of the stabilizers.

15. The system of claim 11, wherein the memory module is disposed on a circuit board that is integrated into one of the stabilizers, wherein the apparatus further comprises a geophone disposed in at least one of the stabilizers for obtaining distributed seismic profiles, wherein the stabilizers comprise fins that extend radially from the outer surface of the body.

16. The system of claim 11, further comprising:

a reel on which the work string is partially disposed;

an injector comprising a drive chain assembly arranged to grip the work string and run the work string into and out of a wellbore;

a stripper mounted on the injector to provide a hydraulic seal around the work string;

a lubricator in a form of a tube arranged to receive the work string from the stripper and contain the work string under pressure;

a blowout preventer installed at a wellhead that receives the work string from the lubricator, wherein the blowout preventer comprises blades for cutting the work string when activated and rams for sealing around the work string when activated; and a work window installed above the blowout preventer through which the external support device is installed on the work string.

17. A method of flow measurement in a wellbore, comprising:

removably coupling an external support device to a portion of a work string, wherein the external support device carries at least one data collection device on the work string, the at least one data collection device comprising a flow sensor operable to measure annular flow between the work string and the wellbore and a memory module coupled to the external support device for storing measurements of the annular flow from the flow sensor;

running the work string into the wellbore to deploy the external support device in the wellbore at a target depth; and obtaining annular flow data with the data collection device in the wellbore with respect to annular flow between the work string and a larger conduit or a wellbore wall, wherein the annular flow data is obtained while the external support device is held at the target depth.

18. The method of claim 17, wherein the work string comprises coiled tubing, and further comprising coupling one or more additional external support devices to the coiled tubing at spaced apart locations, wherein the additional external support devices each support respective data collection devices.

19. The method of claim 17, wherein the external support device further carries at least one geophone, and wherein the method further comprises taking one or more measurements with the geophone in the wellbore to obtain distributed seismic profiles.

20. The method of claim 17, further comprising running a fiber-optic cable into the wellbore with the work string, obtaining data from distributed acoustic sensing and/or distributed temperature sensing with the fiber-optic cable, and combining the data with the annular flow data.

* * * * *